US012768349B2

(12) United States Patent
Davis et al.

(10) Patent No.: US 12,768,349 B2
(45) Date of Patent: Oct. 20, 2026

(54) POWER END FRAME FOR A RECIPROCATING PUMP

(71) Applicant: Kormax Limited, Palmerston North (NZ)

(72) Inventors: Walter Alan Davis, Palmerston North (NZ); Soner Özden Ertürk, Tekirdağ/Çerkezköy (AR); Abrie Van Aarde, Palmerston North (NZ)

(73) Assignee: Kormax Limited, Palmerston North (NZ)

( * ) Notice: Subject to any disclaimer, the term of this patent is extended or adjusted under 35 U.S.C. 154(b) by 0 days.

(21) Appl. No.: 19/263,941

(22) Filed: Jul. 9, 2025

(65) Prior Publication Data

US 2026/0016004 A1 Jan. 15, 2026

Related U.S. Application Data

(60) Provisional application No. 63/669,363, filed on Jul. 10, 2024.

(51) Int. Cl.

| | |
|---|---|
| ***F04B 53/16*** | (2006.01) |
| ***B22C 9/10*** | (2006.01) |
| ***B22C 9/22*** | (2006.01) |

(52) U.S. Cl.

CPC ..... *F04B 53/16* (2013.01); *B22C 9/103* (2013.01); *B22C 9/22* (2013.01)

(58) Field of Classification Search

CPC ..... F04B 53/16; B22C 9/22

See application file for complete search history.

(56) References Cited

U.S. PATENT DOCUMENTS 10,288,081 B1 * 5/2019 Maxwell, III ..... F04D 13/021
2025/0389269 A1 * 12/2025 Waldhoer ..... F04B 1/04

FOREIGN PATENT DOCUMENTS

CN 107208625 A * 9/2017 ..... F04B 53/18

* cited by examiner

*Primary Examiner* — Nathaniel E Wiehe
*Assistant Examiner* — Daniel S Collins
(74) *Attorney, Agent, or Firm* — CHRISMAN GALLO TOCHTROP LLC

(57) ABSTRACT

The application provides a cast power end frame including a pair of end plates and an outer casing extending between the end plates and defining an interior therein; a crank shaft housing extending between the end plates and within the interior of the outer casing, and a plurality of crosshead tubes, each crosshead tube extending substantially perpendicular to the crank shaft housing, wherein the outer casing, crank shaft housing, and crosshead tubes are cast as a single part comprising steel comprising a carbon constituent of 0.06%-1.99% carbon.

12 Claims, 30 Drawing Sheets

POWER END FRAME FOR A RECIPROCATING PUMP

CROSS REFERENCE TO RELATED APPLICATIONS

This application claims the benefit to U.S. Provisional Application No. 63/669,363 filed Jul. 10, 2024, the contents of which are all incorporated by reference in their entirety.

FIELD OF INVENTION

This invention relates to a steel cast power end frame for a reciprocating pump, a reciprocating pump assembly comprising the power end frame, a method of casting the power end frame, a core and a mold for casting the power end frame.

BACKGROUND

Oil field operations commonly utilise reciprocating pumps, especially hydraulically powered reciprocating pumps, for various purposes, such as cementising, acidizing, or fracking/fracturing a well. Typically, the pumps are mounted on a stable but transportable platform, such as the deck of a truck or a skid, for transporting to and between well sites.

The pumps are configured to pressurise a fluid, which may be in the form of a slurry, to very high pressures, such as up to about 20,000 psi, which creates significant pressure and wear on the pump components, and to pump that fluid to a desired location, such as a fracking well or seam. The fluid may comprise corrosive and/or abrasive substances that also create wear on the pump components. In addition, operating the pumps at high pressures and in often unfriendly environments, creates large forces that can cause the pump components to vibrate excessively, which can lead to deformation of one or more components, misalignment between components, excessive wear of one or more components, shearing of components and joins, and failure of the pump.

A reciprocating pump for fracking, and various other operations at well sites, typically comprises a power end coupled to a fluid end by a plurality of stay rods and is configured to receive low pressure fluid from a fluid reservoir and to increase the fluid pressure of the fluid before pumping the fluid to a well for use in fracking. The fluid end takes fluid into a cylinder at lower pressure and discharges the fluid at higher pressure. The power end drives all moving parts required to create the pressure in the fluid end. The moving components of a power end are housed within a metal housing of the power end, commonly referred to as the power end frame. The moving components typically include a crank shaft, crossheads, and connecting rods. A transmission shaft and gear system may also be included in the power end frame or otherwise connected to the power end frame.

The power end frame comprises a crank shaft housing for supporting the crank shaft, and a plurality of crosshead tubes for supporting crossheads of reciprocating crosshead assemblies therein. The fluid end comprises a plurality of cylinders, each cylinder comprising an inlet for receiving the low-pressure fluid, and a discharge outlet for discharging pressurised fluid. One-way flow valves are provided at the inlet and the outlet to ensure one-direction flow from the power end to the fluid end and then from the fluid end to the pipes feeding the well.

During use, rotation of the crank shaft drives reciprocating movement of the crosshead assemblies, such that each crosshead assembly reciprocates back and forth toward and away from a front of the fluid end) within the respective crosshead and cylinders as the crank shaft rotates.

The power end transforms rotary motion of the crank shaft to reciprocating motion of crosshead assemblies that each comprise a crosshead connected to a plunger. The crosshead assemblies move toward and away from a fluid end pump chamber upon rotation of the crank to pressurise fluid in the fluid end and to discharge fluid from a discharge outlet in the fluid end.

Power end frames are typically manufactured from steel components that are welded together identified as a fabrication or weldment. Steel provides the desired tensile properties for a power end frame. But by its very nature, due to excessive vibrations and wear that is typically experienced by reciprocating pumps, especially when fracking, the steel will, at some point, reach its fatigue limit and begin to fail starting at the weld seems and joints formed during assembly or fabrication. Thus, the durability of power end frames made from manufactured steel components that are joined or welded together to form the power end frame, tends to be compromised as it is common for the crosshead tubes to move out of parallel alignment, and for high stress and high wear areas to fail (such as to exhibit a stress fracture or to shear), so as to be rendered unusable. Metal fatigue plays a significant role in pump failure and maintenance costs. Another failure mode is the quality of the welding as this may potentially fail due to weak fusion or partial bond. This could be caused due to difficulty of access to sections or limited internal space to reach all required sections.

It would therefore by useful to provide a single part steel cast power end frame for a reciprocating pump that goes at least some way towards overcoming the disadvantages in the durability of known power end frames, or that at least provides a useful alternative to existing power end frames.

SUMMARY OF INVENTION

In a first aspect, the invention provides a cast power end frame comprising a pair of end plates and an outer casing extending between the end plates and defining an interior therein; a crank shaft housing extending between the end plates and within the interior of the outer casing, and a plurality of crosshead tubes, each crosshead tube extending substantially perpendicular to the crank shaft housing. The outer casing, crank shaft housing, and crosshead tubes are cast as a single part comprising steel comprising a carbon constituent of 0.06%-1.99% carbon. Preferably, the power end frame is cast from alloy steel.

In some forms, each crosshead tube comprises a drainage hole provided in a lower surface of the crosshead tube.

In some forms, at least one oil distribution outlet is provided in the outer casing at a lower portion of the power end frame.

In some forms, a rear portion of the power end frame comprises a plurality of vertical struts having widened portions than other portions of the struts.

In some forms, the power end frame comprises at least three inwardly projecting ribs within an upper portion of the frame, the ribs extending between the end plates.

In a second aspect, the invention provides a reciprocating pump comprising a power end according to the first aspect of the invention, and also comprising a fluid end coupled to the power end by a plurality of stay rods.

In a third aspect, the invention comprises a core segment comprising a front portion from which projects a crosshead plug, a first side comprising a first engagement feature, and a second side comprising a second engagement feature. The first engagement feature of the core segment is adapted to engage with the second engagement feature of an adjacent, second core segment. A plurality of the core segments are stackable horizontally, such that adjacent ones of the core segments engage with each other to form a modular core comprising parallel crosshead plugs for use when casting the power end frame.

In some forms, the first engagement feature nests with the second engagement feature.

In some forms, the first engagement feature comprises a first locating element, and a first guiding surface sloping inwardly from the first locating element to a first abutment surface to form a recessed region within the first locating element, and the second engagement feature comprises a second locating element, and a second guiding surface sloping outwardly from the second locating element to a second abutment surface to form a projecting region within the second locating element.

In some forms, the first locating element comprises an annular collar and the second locating element comprises an annular channel for receiving the collar therein.

In a fourth aspect, the invention provides a modular core for casting a power end frame, the modular core comprising a plurality of core segments according to the third aspect of the invention, the core segments nesting together such that the crosshead plugs of each core segment are parallel with each other.

In a fifth aspect, the invention provides a method of forming a casting mold to cast a power end frame according to the first aspect of the invention, wherein the method comprises the steps of locating a plurality of core segments according to third aspect of the invention in a side-by-side arrangement, pushing the core segments together such that at least one of the first and second engagement features of each core segment engages with at least one of the other of the first and second engagement features of an adjacent core segment to form a modular core, securing the core segments together and locating the core within a casting mold.

In a sixth aspect, the invention provides a method of casting a power end frame according to the first aspect of the invention, the method comprising the steps of connecting at least one ceramic riser to a plurality of runners that are in fluid communication with an interior of a mold and that connect to the mold from beneath the mold, filling the mold interior with molten metal comprising steel comprising a carbon constituent of 0.06%-1.99% carbon within 30 to 60 seconds, and allowing the molten metal to solidify.

In some forms, software is employed to provide real-time animation of the filling of the mold and to provide an indication of comparative temperatures of the metal within the mold to assist an operator to detect weaknesses within the casting.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Reference to any prior art in this specification is not, and should not be taken as, an acknowledgement or any form of suggestion that that prior art forms part of the common general knowledge in the field of endeavour in any country in the world.

The invention consists in the foregoing and also envisages constructions of which the following gives examples only.

BRIEF DESCRIPTION OF THE DRAWINGS

Preferred examples of the invention will now be described by way of example and with reference to the accompanying drawings, in which.

DETAILED DESCRIPTION

The invention is further described with reference to the following examples. It will be appreciated that the invention as claimed is not intended to be limited in any way by these examples.

As exemplified in FIGS. 1 to 30, the present invention relates to a power end frame 100 for a reciprocating pump, such as a hydraulic reciprocating pump used in oil operations, such as fracking cementising, or anodizing.

Reciprocating pumps are typically used to receive fluid from a fluid reservoir, pressurise the fluid, and then discharge the pressurised fluid via an outlet of the pump.

Figure 30:
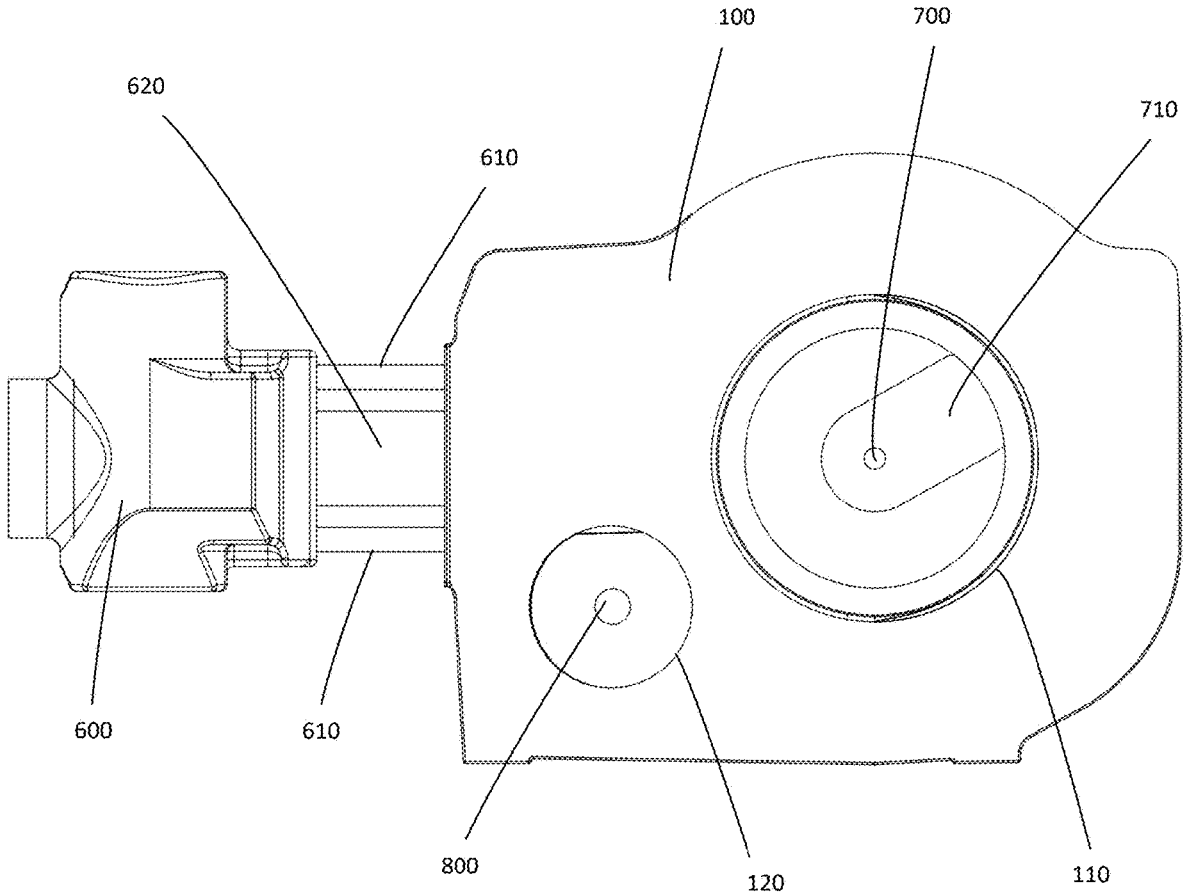
FIG. 30 is an exemplary form of reciprocating pump comprising a power end frame of the invention connected to a fluid end.

A typical reciprocating pump comprises a power end coupled to a fluid end 600 by a plurality of stay rods 610, as shown in FIG. 30. The power end comprises a power end frame 100 in which various pump components are housed. The pump comprises a motor (not shown) that is operably connected to a rotatable crank shaft 700 that is, at least in part, located in a crank shaft housing of the power end frame and comprising a plurality of cranks 710. The crank shaft 700 is rotatable during use.

Typically, the pump also comprises a transmission comprising a rotatable transmission shaft 800. The motor drives the rotation of the transmission shaft that, via a gear system (not shown), rotates the crank shaft 700 at a desired speed. Preferably, the transmission shaft is, at least in part, located within a transmission shaft housing 120 of the power end frame. Alternatively, the transmission shaft may be located external to the power end frame but is connected to the crank shaft via a gear system.

The crank shaft 700 and transmission shaft 800 are typically substantially parallel to each other. In some forms, the transmission shaft comprises opposing ends, each of which may be located at each end of the power end frame, and each of which engage with an element of a gear system, such as a pinion. Where the transmission shaft is housed within the power end frame, ends of the shaft may extend from the transmission shaft housing to connect with a gear system at each end of the transmission shaft.

Each gear system is operably connected to an adjacent end of the transmission shaft and to an adjacent end of the crank shaft. Typically, the transmission shaft engages with a pinion of each gear system and the crank shaft engages with a larger, driven wheel of each gear system. Each gear system is configured to control the speed of rotation of the crank shaft.

Typically, the power end frame includes a pair of end plates that define each end of the frame. Typically, a gear system is located on the outer side of each end plate. A cover (not shown) may be located at each end of the power end frame to encase the gear system between the cover and the respective end plate of the power end frame.

Therefore, the pump is typically configured so that the motor drives rotation of the transmission shaft, which drives the gear system, which drives the speed of rotation of the crank shaft. In such an arrangement, the rotational drive forces are applied at each end of the crank shaft to balance the rotational forces and reduce vibration of the crank shaft, and correspondingly also to reduce vibration of crossheads within the power end frame and of the power end frame as a whole.

The reciprocating pump also comprises a plurality of crosshead assemblies that are each connected to the crank shaft by a respective connection rod. Each crosshead assembly comprises a crosshead connected with a plunger (located in the fluid end). Each crosshead is also connected with the respective connection rod.

The crosshead assemblies are configured to transmit rotational motion of the crank shaft 700 into linear, reciprocating motion of plungers, which are located within cylinders 620 that extend into the fluid end, and are configured to cooperate with the fluid end 600 to pressurise fluid within the fluid end and then discharge fluid from the fluid end.

Each crosshead assembly engages with the crank shaft and comprises a connecting rod, a crosshead and a reciprocating plunger. Each crosshead is mechanically connected with the respective plunger on one side and with the respective connecting rod on the other side of the crosshead. Each connecting rod is mechanically connected to a respective cam of the crank shaft. Thus, each crosshead assembly engages with the crank shaft to cause the crosshead assembly to reciprocate as the crank shaft rotates. Each plunger is at least partially or entirely located in a cylinder of the fluid end. Each crosshead is located at least partially or entirely within a respective crosshead tube of the power end frame.

The crank shaft 700 comprises a plurality of off-set cams 710, each connected to a respective crosshead assembly, to offset movement of at least one or all of the plungers in order to reduce the resulting forward and backward forces exerted on the pump as the plungers reciprocate. Thus, the crank shaft is configured so that at least one or some of the crosshead assemblies move out of sync within at least one or some of the other crosshead assemblies.

The fluid end 600 comprises a plurality of fluid end cylinders that align with, and connect with, the crosshead tubes of the power end to form a substantially continuous crosshead assembly housing for each crosshead assembly—each crosshead assembly housing being partially located in the power end and in the fluid end and extending between the power end and fluid end. The crosshead assemblies are capable of reciprocating back and forth within the crosshead assembly housings (comprising the crosshead tubes of the power end and the cylinders of the fluid end).

Each of the cylinders of the fluid end is in fluid communication with a pressure chamber, which comprises an inlet controlled by an inlet valve, and at least one outlet, each outlet being controlled by an outlet valve.

In operation, the motor drives rotation of the crank shaft (via the transmission shaft and gear system). Optionally, a control system, such as a programmable electronic control system or a mechanically driven control system, may be employed to control rotation of the crank shaft, including its speed of rotation, and also controls operation of the inlet and outlet valves at the fluid end.

Each pressure chamber forms a fluid flow path with the respective plunger cylinder, so that as the crank shaft rotates so that a first set of the plungers (forming a majority of the total number of plungers of the pump) is caused to retract within the cylinders, a vacuum is formed in each pressure chamber, which opens the inlet valve of each pressure chamber to suction low-pressure fluid from a fluid reservoir, through each inlet valve and into the respective pressure chamber. At the same time, rotation of the crank shaft may cause a second set of the plungers (forming a minority of the total plungers of the pump) to extend toward the cylinder to help balance the rearward movement of the first set of plungers. Each of the inlet and outlet valves are configured to allow fluid flow in one direction only, such that reverse fluid flow is not possible. Once the pressure chamber is sufficiently filled with fluid, the reduced vacuum pressure in the pressure chamber causes the inlet valve to close. The crank shaft continues to rotate to cause the first set of plungers to then extend toward the pressure chamber to pressurise the fluid within the chamber. Simultaneously, the second set of plungers retract from the pressure chamber. Once the fluid is pressurised, the high pressure within each pressure chamber causes the respective outlet valve(s) of each pressure chamber to open, and the first set of plungers are caused to continue to extend toward the pressure chamber (whilst the second set of plungers continues to retract) to push the pressurised fluid through the outlet(s). Once sufficient fluid is discharged through the outlet, the reduced pressure within the pressure chamber causes the outlet valve(s) to close. Continued rotation of the crank shaft causes the first set of plungers to retract (and the second set of plungers to extend) to create a low pressure in the pressure chamber to open the inlet valve again and suction more low-pressure fluid into the cylinder to repeat the suctioning, pressurising, and discharging process.

The power end and fluid end therefore cooperate to pressurise fluid and to discharge the pressurised fluid through a discharge valve/outlet valve in the fluid end. In fracking, the pressurised fluid is generally discharged and pumped to a well where it is used in the fracking process.

The fluid that is pressurised comprises water but also often comprises other corrosive and/or abrasive chemicals and materials, such as acids and sand, for example. The resulting fluid may be a readily flowing fluid or a slow flowing, viscous fluid, such as a slurry. At high pressures, the fluid (especially when corrosive and/or abrasive) tends to create wear on the components of the pump, including on the power end frame. Viscous fluid can also lead to increased forces in the pump, creating greater vibrations within the pump and power end frame, and therefore creating increased wear on the components of the pump, including on the power end frame.

To minimise vibrations within the pump and to minimise wear and fatigue on the components of the power end, including the power end frame, the power end frame 100 of the present invention is formed from cast metal, such as a steel grade metal. For example, the power end frame 100 may be cast from a steel grade metal comprising a carbon constituent of between about 0.06% to about 1.99% carbon. Alloy steel has been found to be a suitable material. Steel that satisfies the ASTMA148M standard may also be suitable for casting the power end frame. By reducing vibrations within the pump, it is possible to minimise metal fatigue and therefore extend the useable time period before the power end frame needs to be serviced or replaced due to failure.

By casting the power end frame, it is possible to create a sturdy monolithic, metal frame as opposed to a manufactured metal frame formed of machined components that are then joined together, such as by welding, and therefore are inherently prone to fatigue and failure at the joins. Furthermore, casting allows areas of high wear within the power end frame to be reinforced with thicker walls or framework, or to formed as a monolithic structure, which is not possible using manufactured metal components that are subsequently joined together. As such, a cast power end frame provides a sturdy, robust, and more durable structure for a reciprocating pump with high demands, such as a fracking pump.

But castings are typically made from iron or an iron-rich material to produce a strong, rigid structure. A rigid structure is undesirable for a power end frame, which needs to be formed of a material that comprises sufficient tensile properties to withstand vibrations within the power end. The ideal material has been found to be a steel grade material, which in this specification and claims means a steel material comprising a carbon constituent of 0.06%-1.99% carbon, such as alloy steel, or steel that meets the ASTM A148M standard.

Figure 1:
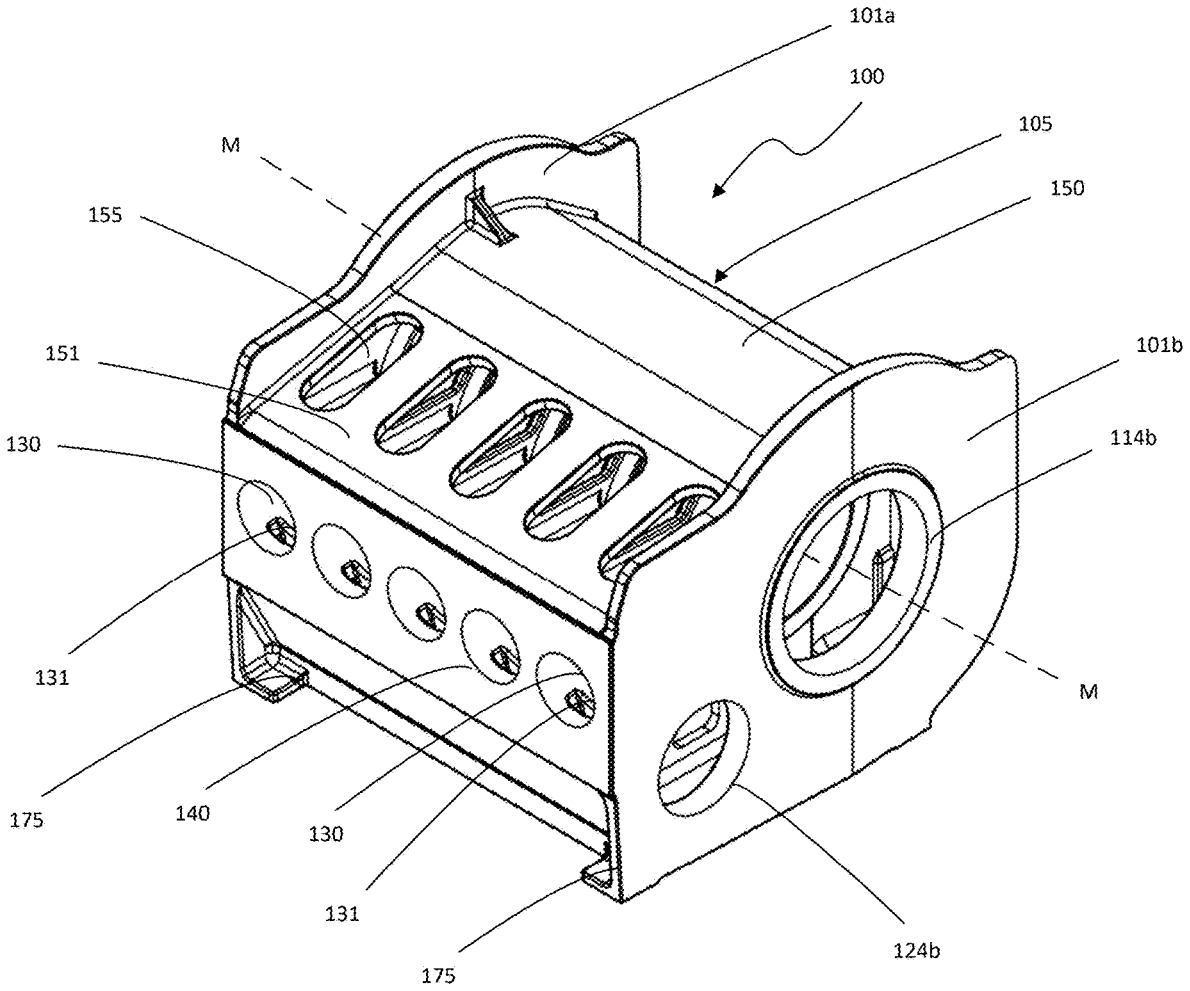
FIG. 1 is an isometric view of one form of power end frame of the invention.
Figure 2:
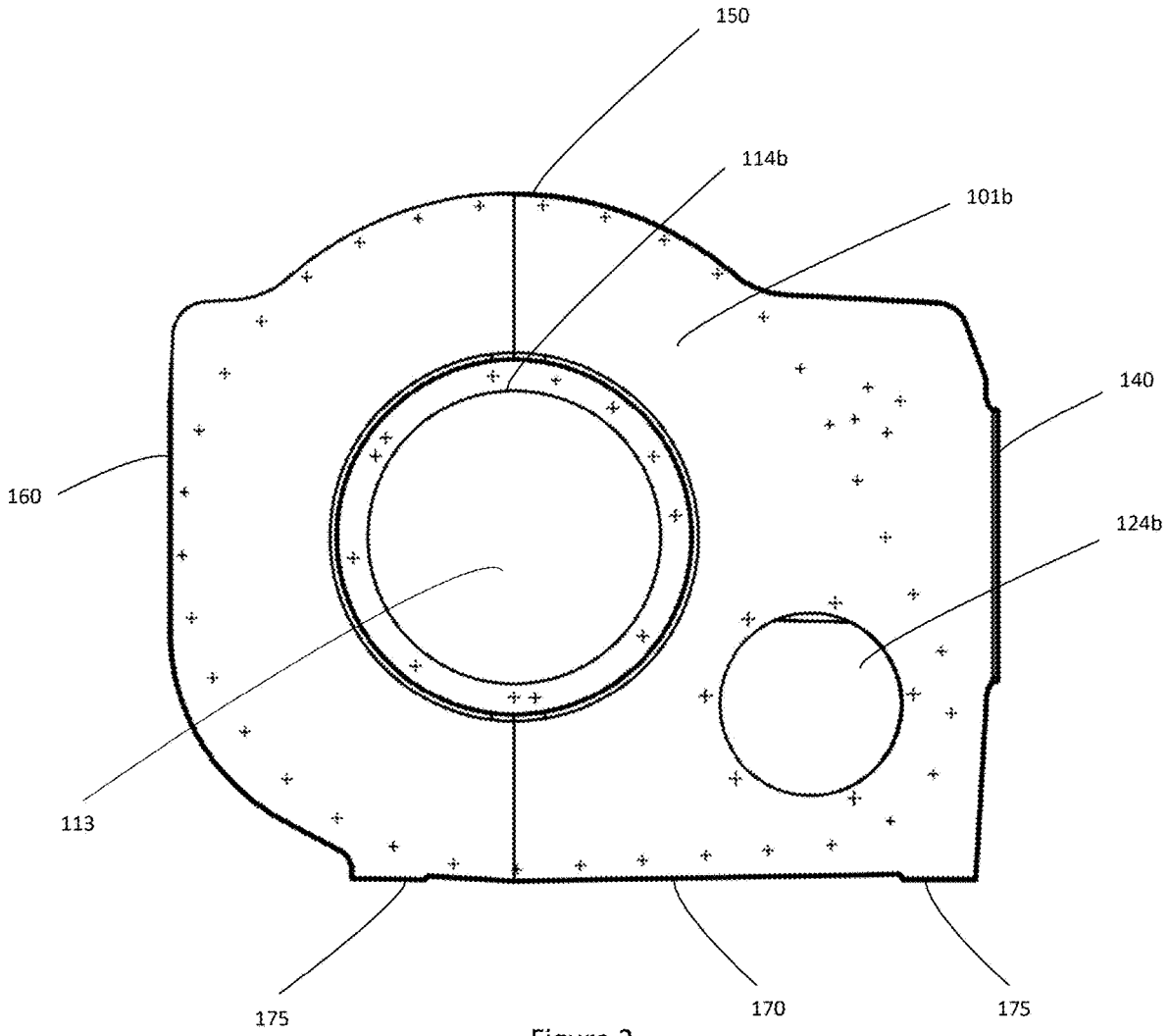
FIG. 2 is a side view of the power end frame of FIG. 1.
Figure 3:
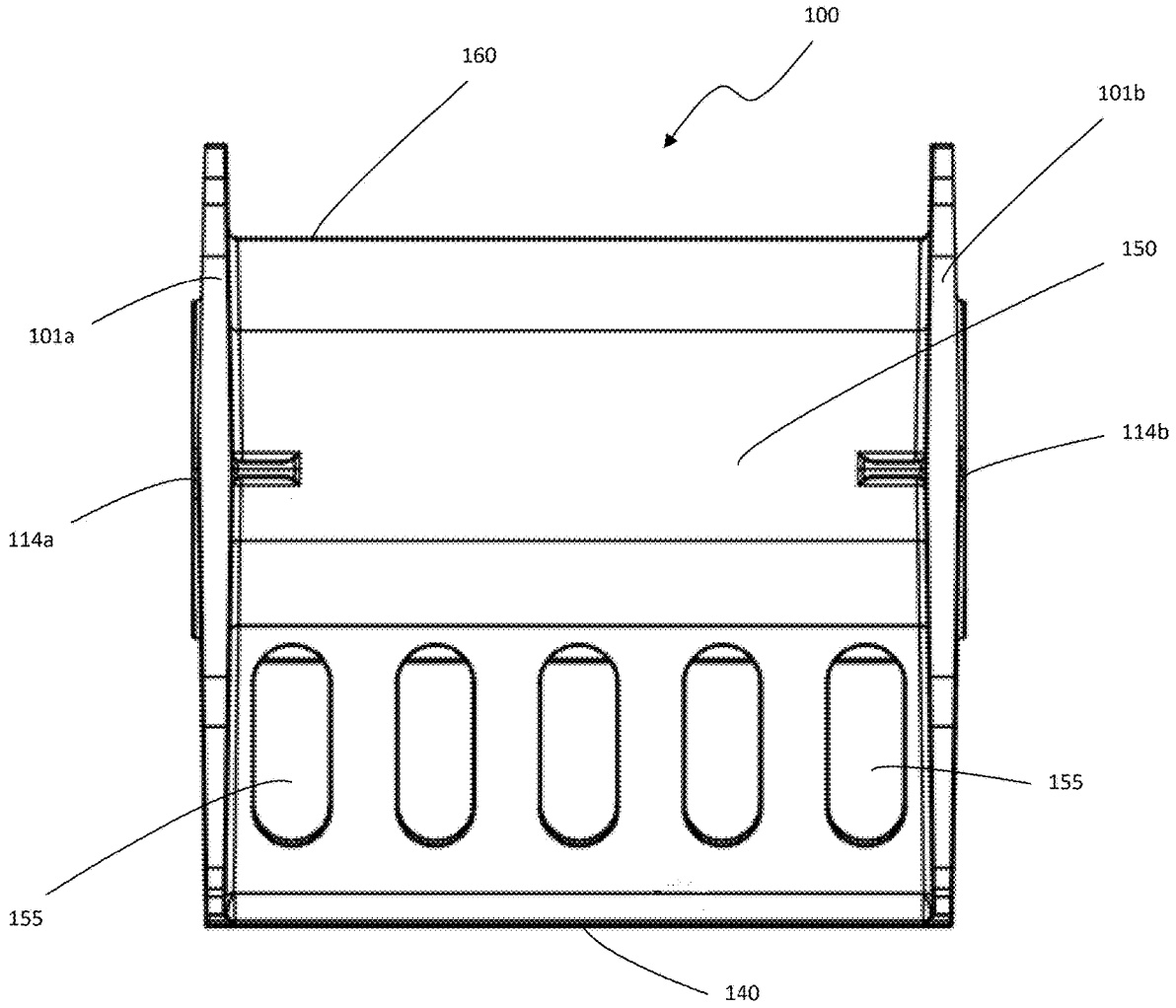
FIG. 3 is a top view of the power end frame of FIG. 1.

As exemplified in FIGS. 1 and 2, the steel cast power end frame 100 of the present invention comprises a pair of end plates 101*a*, 101*b* and an intermediate outer casing 105 extending between the end plates 101*a*, 101*b* and defining an interior therein. The end plates 101*a*, 101*b* define the width of the power end frame 100 and are located on the left and right sides of the frame 100.

A structural framework 102 is provided within the interior of the frame 100 and is configured to support various components of the pump.

The power end frame 100 also comprises a crank shaft housing 110, defined by the framework 102 within the interior of the outer casing 105 and extending the length of the power end frame 100 between the end plates 100*a*, 100*b*. The crank shaft housing 110 is configured to, at least partially, receive a rotating crank shaft of the reciprocating pump therein. In some forms, as shown in FIGS. 2, 6, 9, and 10, the housing 110 comprises a plurality of annular bearings 111 comprising substantially aligned arcuate inner surfaces 112 that define a substantially cylindrical hollow region 113 within the crank shaft housing. The aligned inner bearing surfaces 112 form a substantially cylindrical supporting structure for receiving the rotating crank shaft within the hollow region 113. Typically, the crank shaft extends horizontally along its length and the cylindrical hollow region 113 extends horizontally along the width of the power end frame 100. Preferably, as shown in FIG. 1, the crank shaft housing 110 comprises a virtual axis M-M extending centrally along the length of the cylindrical hollow region 113. The crank shaft virtual axis defines, and is therefore coincident with, a rotational axis of the crank shaft within the crank shaft housing 110.

In the example shown in FIGS. 1 and 2, the crank shaft housing 110 is located to the rear of the power end frame 100, behind a plurality of crosshead tubes 130 that are directed toward the fluid end.

Each end of the crank shaft housing 110 comprises a housing opening 114*a*, 114*b* that is located in a respective end plate 101*a* 101*b* of the power end frame 100. For example, each end plate 101*a*, 101*b* may comprise a first opening/housing opening 114*a*, 114*b* that defines an open end of the crank shaft housing 110 through which the crank shaft can be located and accessed, and through which ends of the crank shaft may project. Preferably, the housing opening 114*a*, 114*b* is circular and substantially aligns with the arcuate inner surfaces 112 of the annular bearings 111 of the crank shaft housing. In some forms, each crank shaft opening 114*a*, 114*b* may comprise a thickened collar or rim around the opening for additional strength.

The annular bearings 111 of the crank shaft housing 110 are distanced from each other and define a gap 115 in between. Each gap 115 allows a respective cam of the crankshaft to project therethrough and connect with a crosshead assembly of the pump. In effect, each inner bearing surface 112 supports the crank shaft and each gap 115 between adjacent inner bearing surfaces 112 receives a cam of the crank shaft therein, such that each cam projects into a respective gap 115 to engage with a crosshead of a respective crosshead assembly.

In some forms, a transmission shaft housing 120 is also located within the interior of the outer casing 105 and defined by the structural framework 102. The transmission shaft housing 120 typically comprises a substantially cylindrical hollow interior comprising an arcuate support surface 122, and extends the length of the power end frame 100 between the end plates 101*a*, 101*b*. The transmission shaft housing 120 is substantially parallel to the crank shaft housing 110, and is configured to, at least partially receive a rotating transmission shaft of the pump therein.

Each end plate 101*a*, 101*b* may comprise a second opening/transmission shaft opening 124*a*, 124*b* that is preferably a circular opening comprising a periphery that substantially aligns with the arcuate support surface 122 of the transmission shaft housing 120. The transmission shaft openings 124*a*, 124*b* allow for a transmission shaft to be located within the transmission shaft housing 120 and for ends of the transmission shaft to project through the openings 124*a*, 124*b*.

The power end frame 100 also comprises one or more crosshead tubes 130. Each crosshead tube 130 preferably extends substantially perpendicular to the crank shaft housing 110 and is aligned with a respective gap 115 between adjacent inner bearing surfaces 112 of the housing 110.

Each crosshead tube 130 is configured to locate at least a crosshead of a reciprocating crosshead assembly therein. As discussed above, each crosshead assembly comprises a reciprocating plunger connected to a reciprocating crosshead, the movement of which is controlled by rotation of the crank shaft. Each crosshead is connected to the crank shaft by a connecting rod that engages with a respective cam of the crank shaft within the gap 115, and is configured to transfer rotational movement of the crank shaft into reciprocal movement of the respective crosshead assembly.

Preferably, the power end frame comprises a series of crosshead tubes that are horizontally aligned with, and perpendicular to, the crank shaft. In the embodiment shown, the power end frame 100 comprises five crosshead tubes 130 for receiving five crosshead assemblies, so that one crosshead is located in each of the five crosshead tubes 130. However, in other forms, the power end frame may comprise fewer or more crosshead tubes for accommodating a pump comprising fewer or more crosshead assemblies. For example, the power end frame may be configured to comprise three crosshead tubes to receive a three crosshead assemblies therein. In other forms, the power end frame may be configured to comprise four, or six crosshead tubes to receive four, or six plungers respectively.

The crosshead tubes 130 are typically horizontally aligned in parallel and distanced from each other. The crosshead tubes 130 extend in a direction that is substantially perpendicular to the longitudinal direction of the crank shaft housing 110, such that each crosshead tube 130 extends toward the front of the power end frame 110, where the crosshead tubes 130 terminate at a front plate/front face 140 of the outer casing 105.

Figure 5:
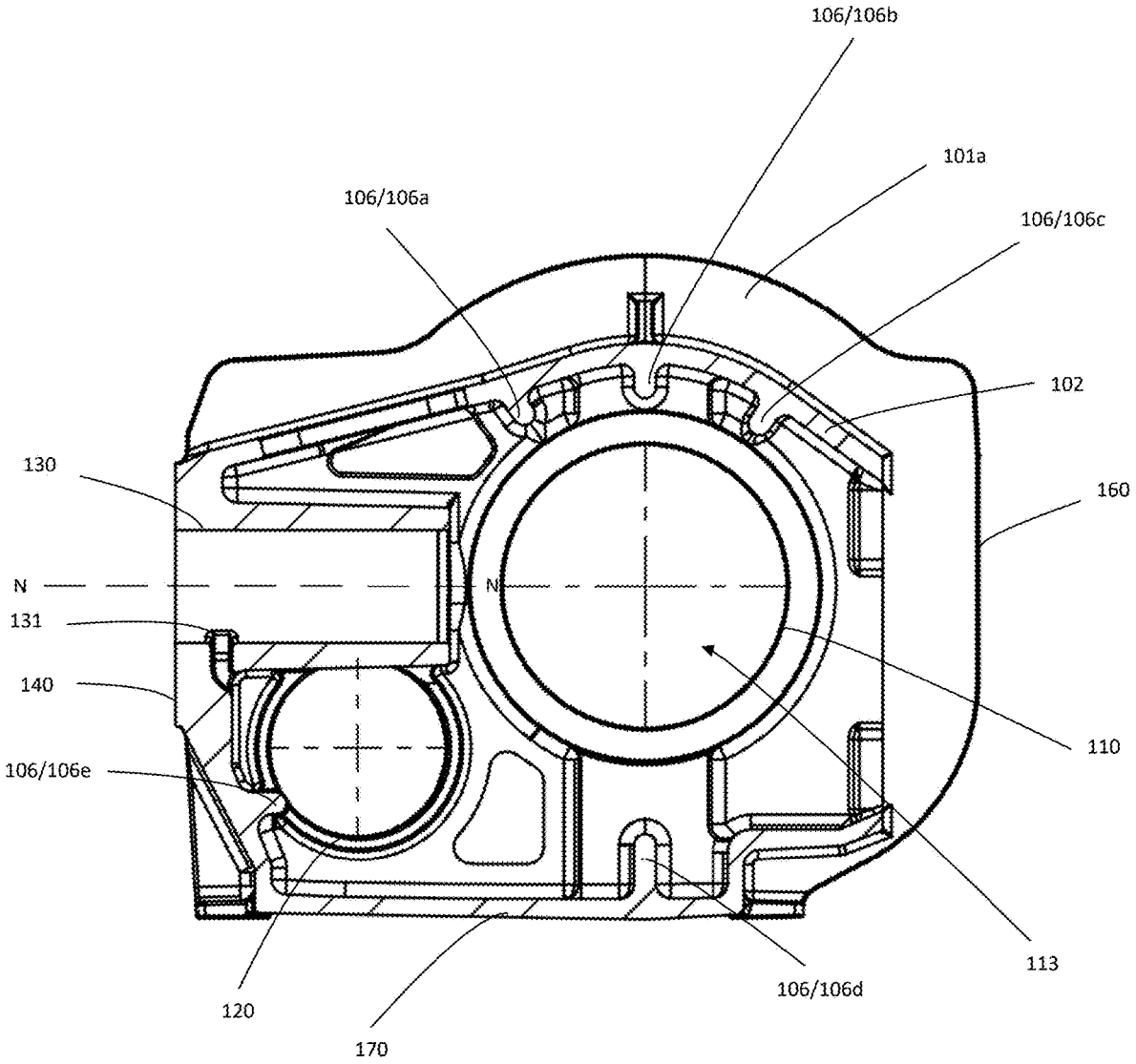
FIG. 5 is a cross-sectional side view of the power end frame taken through line A-A of FIG. 4.
Figure 6:
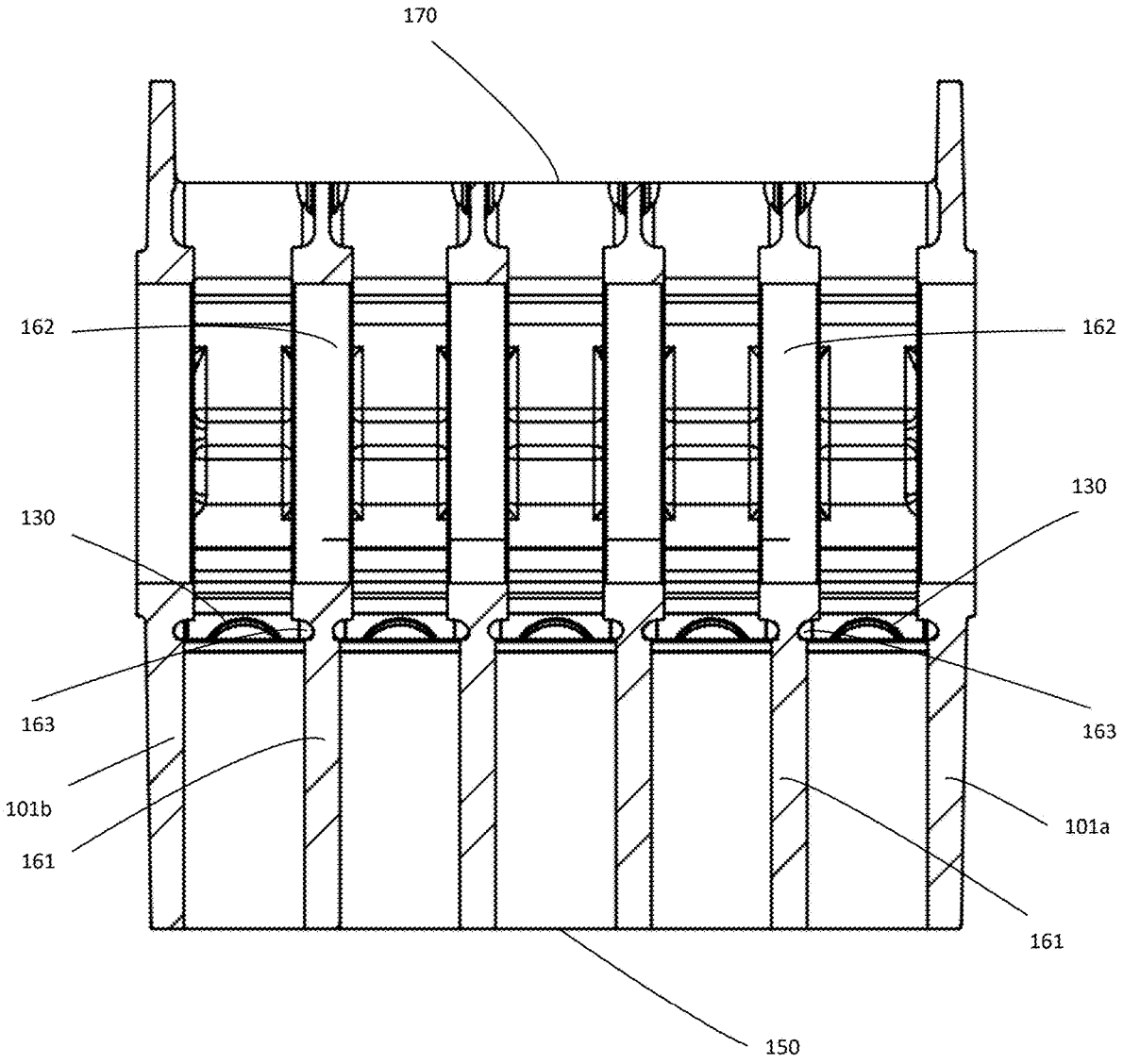
FIG. 6 is a cross-sectional top view of the power end frame taken through line B-B of FIG. 4.

Preferably, each of the crosshead tubes 130 are also substantially cylindrical and each define a virtual plunger axis extending centrally along the length of the crosshead tube. As shown in FIG. 5, each plunger axis preferably defines, and is therefore coincident with, a virtual central, longitudinal axis N-N of a plunger located within each crosshead tube 130. The plunger axes N-N are substantially perpendicular to the crank shaft rotational axis M-M, and preferably lie in the same horizontal plane as the crank shaft axis.

Figure 10:
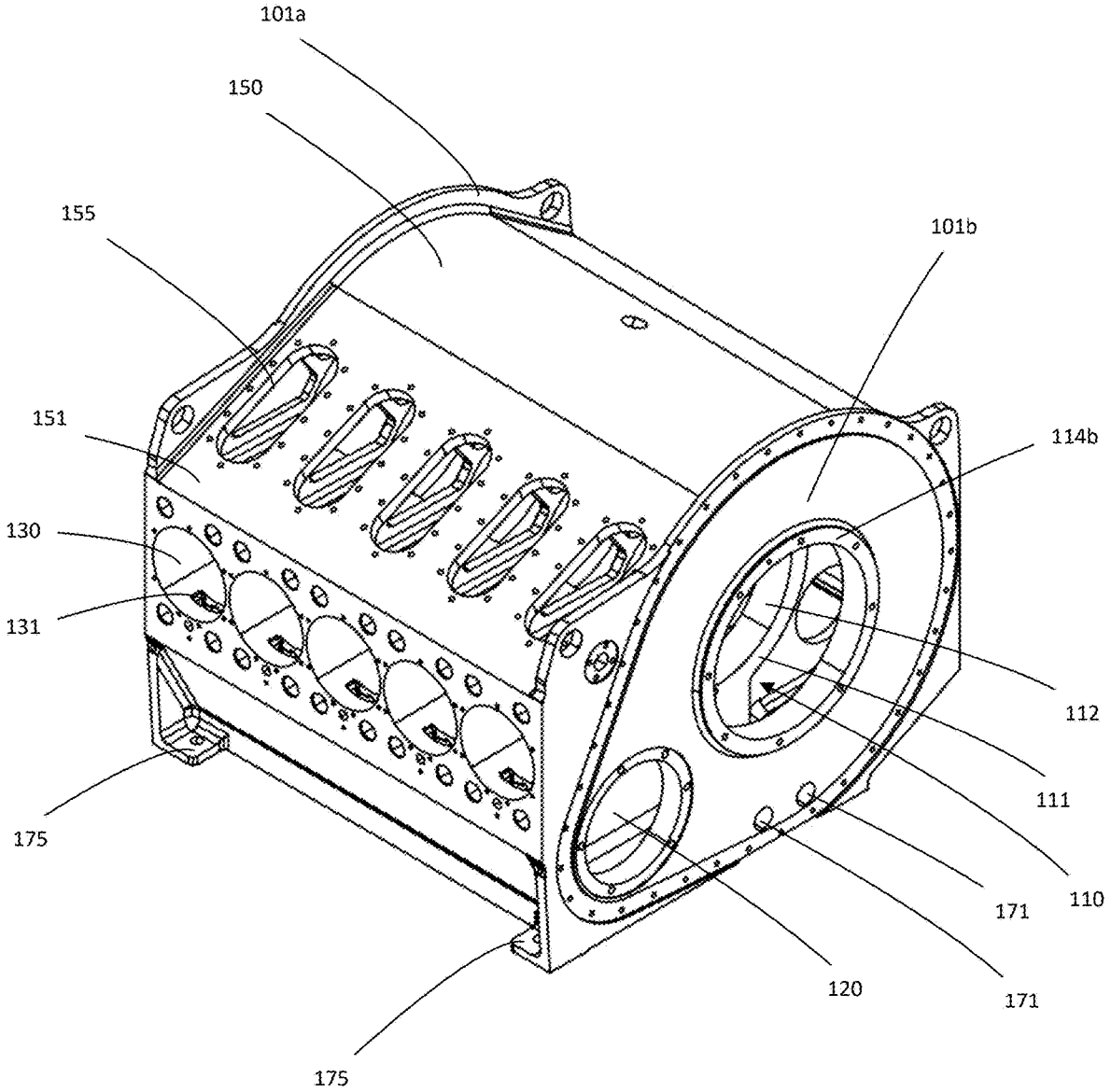
FIG. 10 is an isometric view of the power end frame of FIG. 8.
Figure 11:
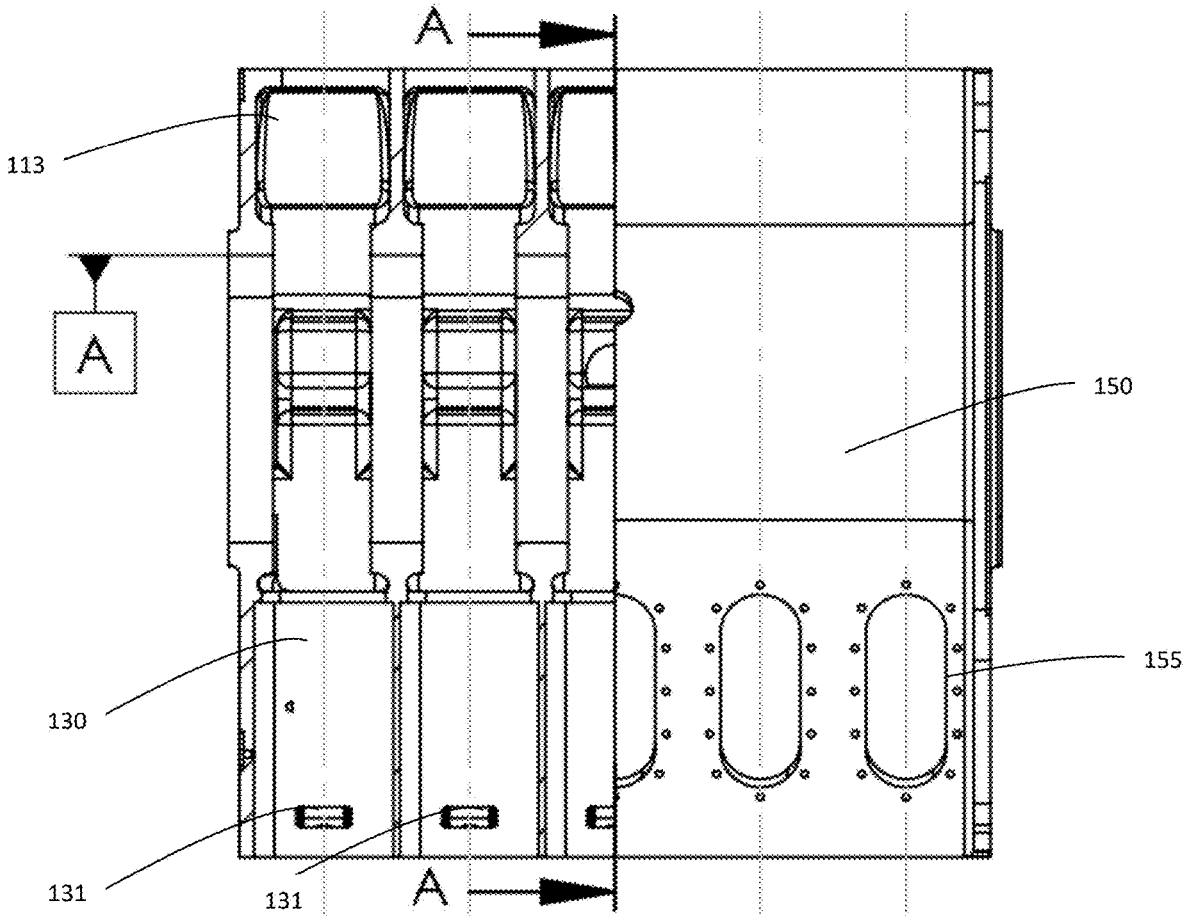
FIG. 11 is a partial cut-away top view of the power end frame in which the drainage holes are visible in the crosshead tubes lying beneath inspection ports.

In some forms, as shown in FIGS. 1, 5, and 10, each crosshead tube 130 comprises a drainage hole 131 located in a lower region of the tube 130 to drain away excess fluid, such as oil, and any built up debris within the tube 130.

In some forms, the crosshead tubes 130, crank shaft housing 110, and outer casing 105 are cast as a single part. In such forms, the drainage holes 131 in the crosshead tubes 130 may be formed during the casting process or subsequently machined into the casting. In some forms, a tubular steel sleeve may be located within each crosshead tube 130 after casting and at least one drainage hole may be machined into, or formed within, the steel sleeve and the sleeve may be located within the respective tube 130 so that the drainage hole(s) of the sleeve align with the corresponding drainage hole(s) of the crosshead tube 130.

The outer casing 105 of the power end frame 100 comprises a front plate/front face 140. The outer casing also comprises an upper portion 150, a rear face 160, and a lower portion 170. The front face 140 comprises a plurality of crosshead tube openings 145. Each opening 145 defines an open end of a respective crosshead tube 130. Thus, the crosshead tube openings 145 are distanced from each other and aligned horizontally in parallel along the front face 140 of the outer casing so as to extend across a portion of the width of the power end frame 100.

Preferably, each crosshead tube 130 is substantially cylindrical and comprises a circular lateral cross-section such that each circular opening 145 in the front face 140 defines a substantially seamless entry into the interior of the respective crosshead tube 130.

Because the end plates 101*a*, 101*b*, interior framework, outer casing 105, front face 140 and crosshead tubes 130 are simultaneously cast within the structure of the power end frame, the alignment of the crosshead tubes 130 relative to each other is fixed and does not move regardless of the duration and extent of vibrations experienced by the power end frame 100. In effect, the inability of the crosshead tubes 130 to move relative to each other, and relative to other components of the power end frame 100 and pump, limits the vibrations within the power end frame, such that the vibrations experienced by the power end frame of the invention are less than those typically experienced by a power end frame in which the crosshead tubes are separately formed and are subsequently attached together, such as by welding, for example. In such cases, the joins between the crosshead tubes tend to form areas of weakness and may fail/separate as a result of persistent vibrations over time.

The upper portion 150 of the outer casing 105 comprises one or more inspection/maintenance ports/inspection openings 155, each port 155 being positioned above a respective crosshead tube 130 to allow a user to visually inspect each crosshead tube 130 and to access the crosshead assembly or crosshead within the tube 130. Thus, one inspection port/opening 155 is typically provided for each crosshead tube 130. Typically, each inspection port is an oblong shape extending in the longitudinal direction of the crosshead tubes 130, as shown in FIG. 1. A removable hatch cover (not shown) may be secured to the outer casing 105 to cover each inspection port 155, such as by using screw fasteners that engage with threaded openings provided in the outer casing, to minimise the risk of debris entering each crosshead tube 130.

As shown in FIGS. 1 and 10, the upper portion 150 of the outer casing comprises an inspection panel 151 in which the inspection ports 155 are located. The inspection panel 151 slopes downwardly toward the front face 140 of the power end frame. Preferably, the inspection panel 151 slopes at an angle of between about 15° to about 40° from horizontal and is preferably sloped at an angle of about 20° to horizontal. By providing an inspection panel 151 with a shallow angle to horizontal, it can be easier for a person to reach into each inspection port 155 to access the interior of the power end frame 100, such as to access the crosshead assemblies within each crosshead tube 130. For example, a person may carry a heavy machine part or a lubricant dispenser that needs to be located within a crosshead tube 130, or the part may need to be extracted from a crosshead tube 130. Providing inspection ports 155 with a shallow angle to horizontal means that the size of the accessible port/opening 155 from above is greater than if the port was located on an inspection panel 151 with a greater angle to horizontal and, as such, manipulating a heavy machine part through an inspection port 155 is easier if the port/opening 151 from above is as large and accessible as possible.

The inspection ports 155 are located in series (i.e. in a side-by-side arrangement) along the inspection panel 151 and directly above each crosshead tube 130. The inspection ports 155 are positioned parallel to each other, each having a centre that lies along the same horizontal plane.

In some forms, the upper portion 150 of the outer casing 105 comprises an arched, outwardly curved region toward the rear of the inspection panel 151 and power end frame 100. The curved region is configured to accommodate the crank shaft housing 110 within the outer casing 105. The curved region of the upper portion 150, together with the forward sloping inspection panel 151, are configured to minimise material cost for manufacture of the power end frame 100 by closely following the outline shape of the crosshead tubes 130 and crank shaft housing 110. However, the upper portion may be of any suitable shape. For example, in other forms, the upper portion may be flat, angular, or even concave, provided that sufficient space is provided for the crank shaft housing within the interior of the outer casing.

The rear face 160 is located at the rear of the power end frame 100 between the upper portion 150 and the lower portion 170. The rear face 160 is preferably, but not essentially, parallel with the front face 140.

In some forms, the rear face 160 may comprise a framework comprising a plurality of struts 161 extending between the upper and lower portions 150, 170 of the frame 100. Preferably, the struts are substantially vertical. An operating space is provided between adjacent struts 161 to allow access to the interior of the power end frame 100 from the rear. Preferably, the struts 161 are located to substantially align with the gaps 115 between the crosshead tubes 130, so that each crosshead tube 130 aligns with a respective operating space between adjacent struts 161. In such an arrangement, the crosshead tubes (and the crosshead assemblies located therein) are accessible from the rear of the power end frame 100.

In some forms, the struts 161 may comprise at least one widened portion 162 to provide the rear face 160, and therefore the power end frame 100, with additional structural strength and to absorb at least some of the vibrations created during operation of the reciprocating pump. In effect, the widened portions 162 may act as a vibration damper. In some forms, a widened portion 162 may be provided at an upper region and/or at a lower region of each strut. In other forms, a widened portion 162 may be provided at a substantially central region of each strut. In some forms, as shown in FIG. 5, each strut 161 may comprise a narrow neck 163 adjacent to at least one end, and preferably adjacent to opposing ends of, the widened portions 162, as shown in FIG. 5. Optionally, the widened portion(s) 162 may be between about 35 mm and about 65 mm wide, and preferably about 50 mm wide. Optionally, the non-widened portion(s) may be between about 20 mm and about 30 mm wide, preferably about 25 mm wide. Optionally, the narrow neck portion(s) 163 may be between about 15 mm and about 30 mm wide, preferably about 20 mm wide. In other forms, each strut 161 may be of a substantially consistent width along its length. The widened portions 162 of the struts 161 may also reduce defects from forming in the casting during the casting process by enabling feeding of the associated riser(s).

Figure 4:
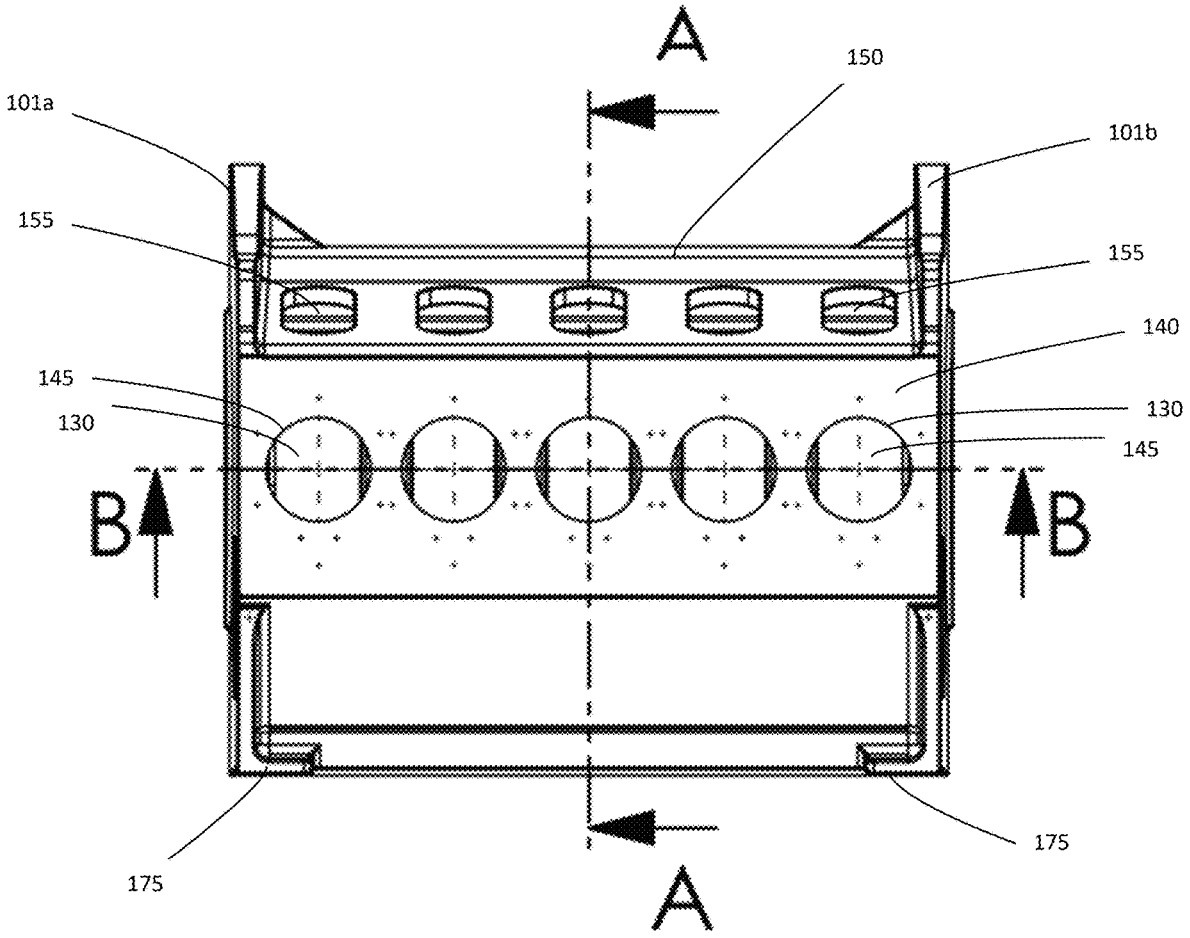
FIG. 4 is a front view of the power end frame of FIG. 1.

The lower portion 170 of the power end frame 100 extends across the lower surface of the frame 100 and comprises a plurality of feet 175 to support the remainder of the frame 100 above. In some forms, the lower portion 170 of the outer casing 105 comprises a base plate from which the feet 175 project, as shown in FIGS. 1 and 4. Preferably, the base plate is a substantially quadrilateral shape, such as a square or rectangular shape, and at least one foot 175 is located at each corner of the base plate. In other forms, the feet 175 may project from the interior framework 102 of the frame 100.

Figure 7:
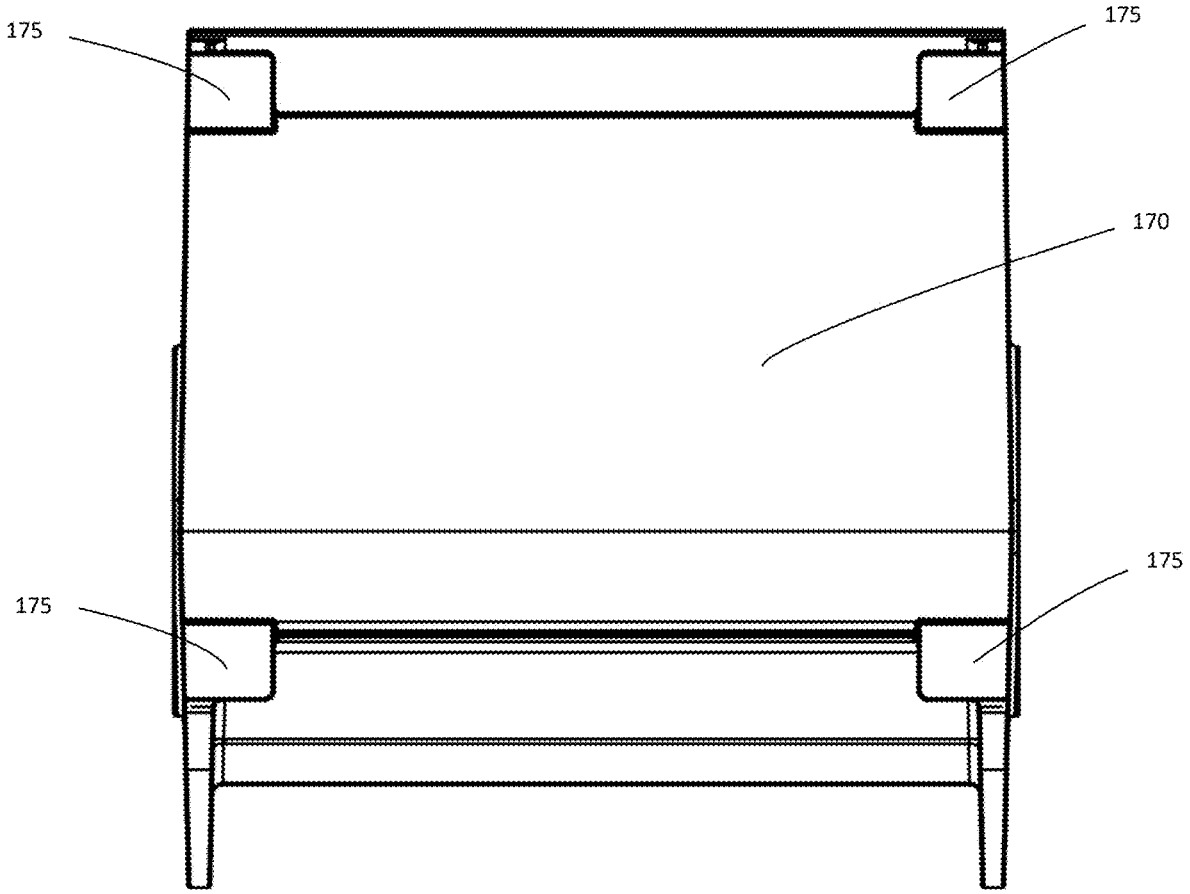
FIG. 7 is a bottom view of the power end frame of FIG. 1.
Figure 8:
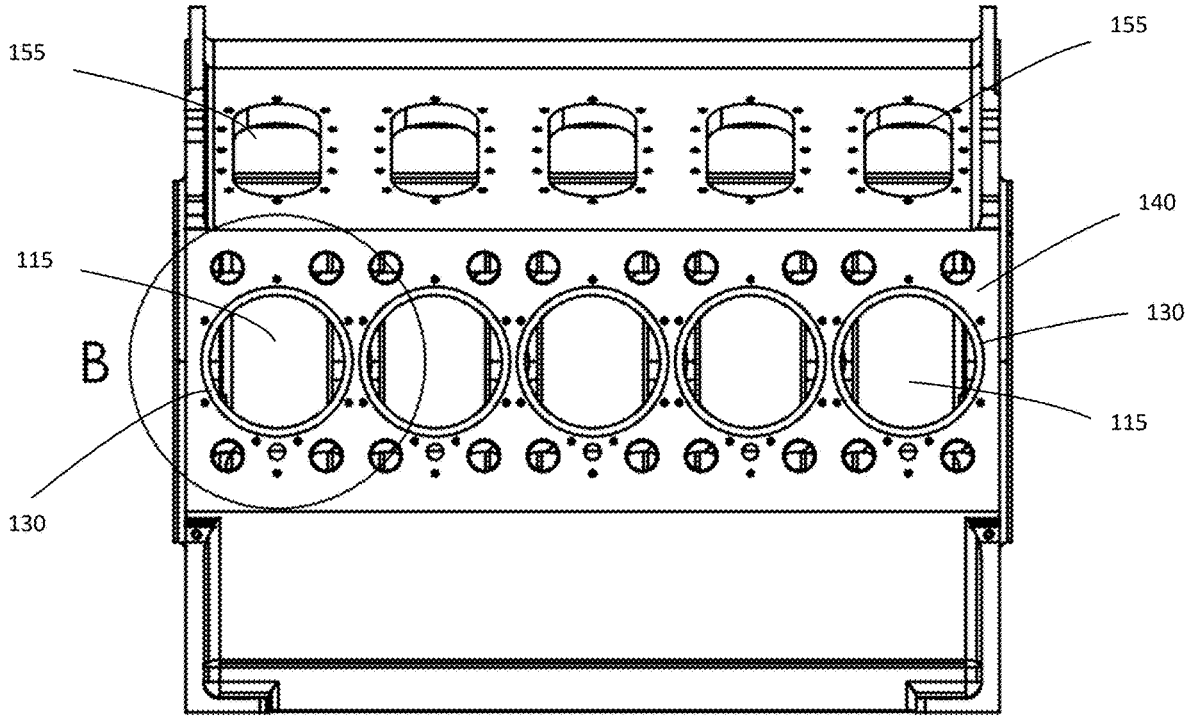
FIG. 8 is a front view of a power end frame that has been cast and then machined to include fastening apertures and openings for stay rods to connect the power end to a fluid end.
Figure 9:
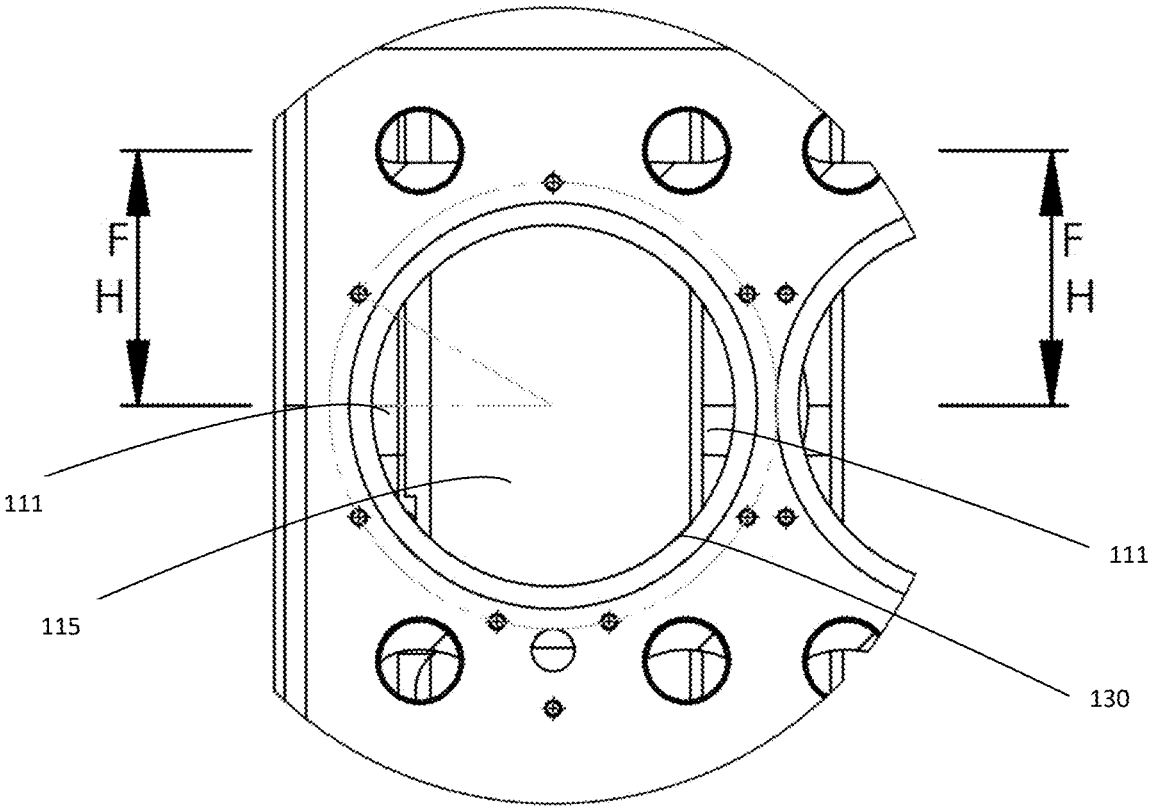
FIG. 9 is an enlarged view of area B from FIG. 8 and shows the gap between adjacent crank shaft bearings and behind the crosshead tubes.

In some forms, as shown in FIGS. 4 and 7, the power end frame 100 is supported by a plurality of plate-like feet 175 that are located at the bottom of the lower portion 170 of the outer casing 105 to support the body of the power end frame from below. The plate-like feet 175 provide a stable base for the power end frame and can readily be slid across a flat surface, if required.

Figure 16:
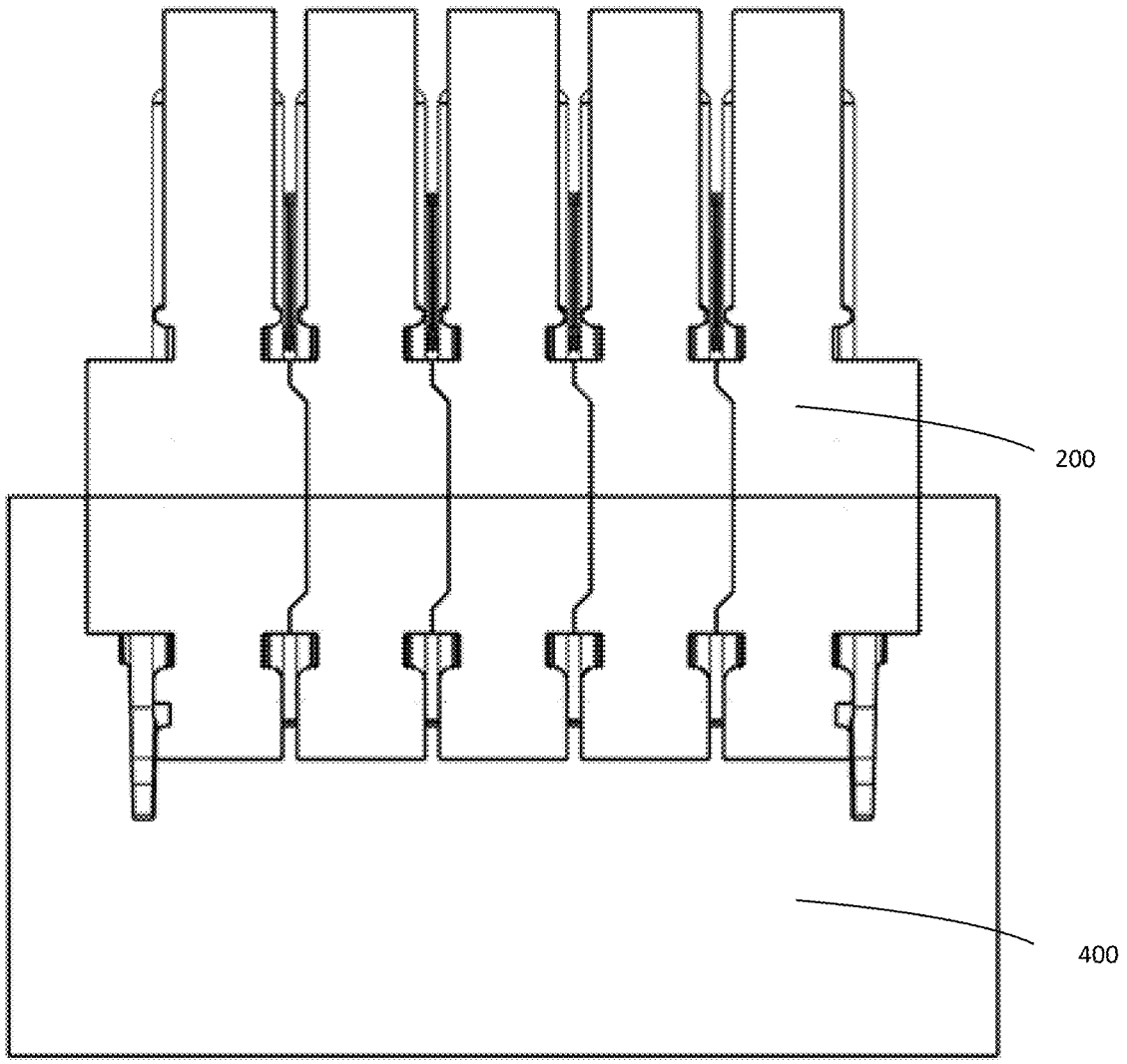
FIG. 16 is schematic cross-sectional front view of the modular core within one half of the molding box, as indicated in FIG. 15, and showing the core segments nesting together.
Figure 21:
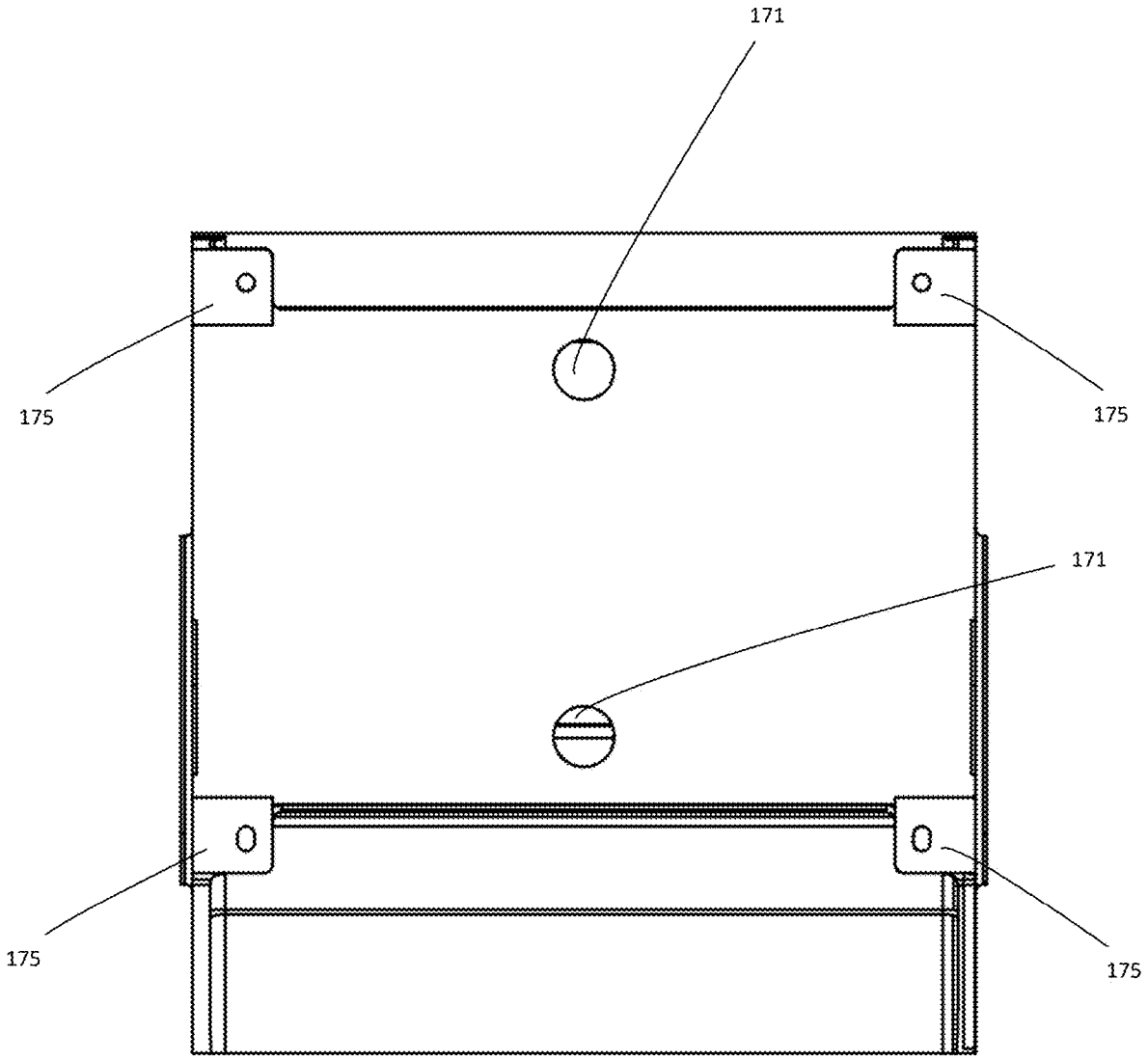
FIG. 21 is a bottom view of the power end frame of FIG. 17 and in which drainage holes are provided in a base plate in the lower portion of the frame.

In some forms, as shown in FIGS. 10, 16 and 21, the power end frame 100 comprises one or more fluid drainage holes 171 in the lower portion 170 of the outer casing 105. For example, one or more fluid drainage holes 171 may be provided in a base plate of the power end frame. The fluid drainage holes 171 are useful for allowing the drainage of oil and other fluids that are otherwise trapped in the bottom of the power end frame 100.

Figure 12:
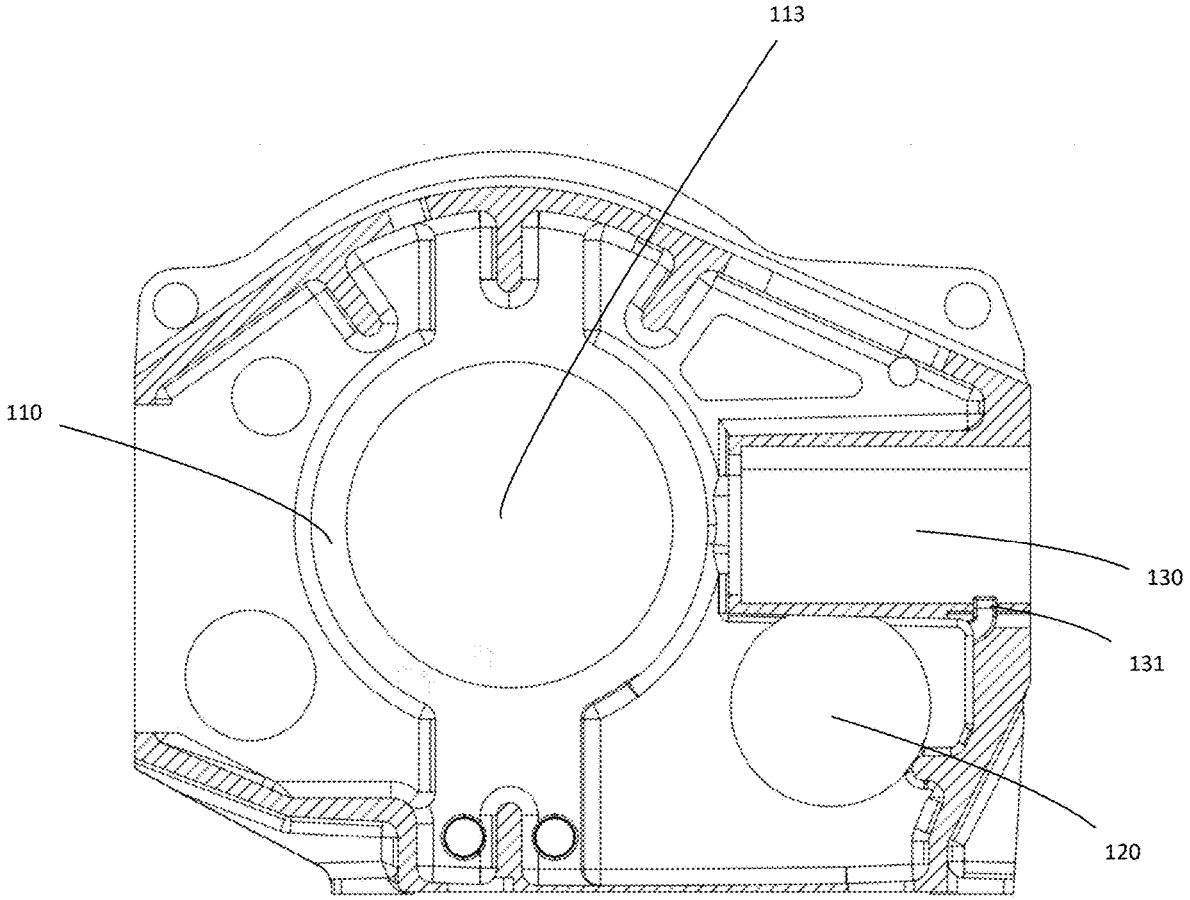
FIG. 12 is a cross-sectional side view taken along line A-A of FIG. 11.

In some forms, as shown in FIGS. 5 and 12, the interior framework 102 of the power end frame 100 may also comprise a plurality of inwardly directed structural support elements/ribs 106 that project into the interior of the outer casing 105. The ribs 106 extend laterally along the width of the outer casing 105 of the power end frame 100 and provide additional structural strength to the power end frame 100 by minimising lateral movement and resulting vibrations. In some forms, as illustrated, three evenly spaced, inwardly projecting ribs **106*a*, 106*b*, 106*c* are provided at the upper portion 150 of the outer casing and are directed toward the crank shaft housing 110. In such a scenario, the central rib 106*b* may be substantially vertical and the outer ribs 106*a*, 106*c* may be angled toward the central longitudinal axis of the crank shaft housing 110. In some forms, at least one inwardly directed rib 106*d* is provided at the lower portion 170 of the outer casing and is directed toward the crank shaft housing 110, preferably toward the central longitudinal axis of the crank shaft housing. Thus, the crank shaft housing may extend longitudinally, and substantially centrally, between the elongate laterally extending ribs 106*a*-106*d***

Additionally, or alternatively, the interior framework 102 of the power end frame 100 may comprise a laterally extending elongate transmission support rib **106*e* that projects toward the optional transmission shaft housing 120 and extends longitudinally parallel to the transmission shaft housing. In some forms, as shown in FIG. 12, the rib 106***e* projects from the front region of the lower portion 170 of the outer casing 105.

The ribs 106 provide additional structural support and stiffness to the power end frame and have also been found to disrupt pressure and sound waves travelling through the power end frame, thereby reducing resulting vibrations in the power end frame 100. The ribs 106 may also assist with the casting process by helping to manage the thermal gradient between cooling metal and hot, molten metal being added to the casting. By effective management of the thermal gradient, it is possible to minimise thermal hot spots, which tend to create undesirable porosity and weakness in the cast power end frame.

The power end frame 100 is preferably sized to fit on a typical truck deck or skid to transport a reciprocating pump comprising the power end frame to and from a well site. Typically, the power end frame 100 is about 1,144 mm high×1,380 mm wide×1,386 long (from front to back).

The power end frame 100 may also be configured to be of a weight that is transportable by a typical truck or skid. For example, the weight may be between about 5000-7,000 pounds, and is preferably about 6,100 pounds.

To minimise vibrations, wear, and the risk of shearing and breakage within the power end frame, the interior framework 102, outer casing 105, ribs 106, crank shaft housing 110, optional transmission shaft housing 120, and crosshead tubes 130 may be cast as a single part. In preferred forms, the end plates 101*a*, 101*b* are also cast together with the interior framework 102, outer casing 105, ribs 106, crank shaft housing 110, optional transmission shaft housing 120, and crosshead tubes 130. Thus, the power end frame may be substantially or entirely formed as a single cast element within which the mechanical moving parts of the pump (such as the crank shaft, crosshead assemblies, and transmission shaft) may be located. In embodiments where the end plates 101*a*, 101*b* are not included in the overall casting, the end plates 101*a*, 101*b* may be separately cast or otherwise manufactured and then welded or bolted to each end of the outer casing 105. However, to reduce vibrations and increase the robustness of the power end frame 100, it is preferred that the outer casing 105 and end plates 101*a*, 101*b* are cast together.

Tests have shown that a single cast power end frame of the invention tends to have greater strength and durability than a power end frame comprising multiple components that are independently attached together to form the power end frame.

The manufacture of a power end frame must meet stringent demands to satisfy the operational environment, especially that of the oil and gas industry. For example, the material of the cast power end frame should have mechanical properties to assist the durability of the power end frame. For example, suitable materials include mechanical properties, such as a tensile strength above 600 MPa, elongation above 15%, fatigue strength above 280 MPa, an elastic modulus above 190 GPa, and vibration dampening properties. It has been found that steel grade material has suitable mechanical properties. Alloy steel having a Youngs Modulus of approximately 190 GPa has particularly suitable mechanical properties. However, it has not previously been possible to cast a power end frame of steel grade material, such as an alloy steel.

The mold and molding process of the invention have also been developed to meet alignment tolerances for the crosshead tubes 130. For example, the power end frame 100 of the invention requires hollow interior regions to form the crank shaft housing 110, the optional transmission shaft housing 120, and the crosshead tubes 130. It is not generally possible to form hollow interior regions of a casting from a mold pattern alone, so a modular core 300 has been created for placement within the mold created by the pattern.

To cast a power end frame, a molding box 400 is provided within which is initially located a pattern. The pattern bears the external shape/geometry of the product to be cast within the molding box (in this case the cast structure of the power end frame). The molding box 400 is then filled with a particulate 420, such as sand, to fill the space between the molding box and the pattern. The particulate is then compressed and solidified with the aid of a setting agent, such as chemicals, that cause the particulate to harden around the shape of the pattern. The pattern is removed and its imprint remains formed in the hardened particulate material—thus forming a mold within the molding box.

Typically, the pattern is formed as a pair of opposing pattern halves, such as a top half and a bottom half. The pattern halves have exterior surfaces with an external geometry that is shaped to create the external shape of the cast power end frame 100. Providing two pattern halves, means that the molding box can be formed in two halves and one half of the pattern can be removed at a time to expose the mold.

The exterior surfaces of the pattern create the shape of the mold and are used to create the exterior shape of the power end frame. However, the interior surfaces of the power end frame must be created using a core 300. For example, a core 300 may be located within the hollow interior of the mold to create hollow regions within the power end frame 100, such as the crank shaft housing 110, the optional transmission shaft housing 120, and the crosshead tubes 130.

However, to minimise vibrations within the power end frame 100 and the reciprocating pump generally, and to maximise the efficiency, effectiveness, and durability of the pump, it is imperative that the crosshead tubes 130 are accurately aligned with each other in parallel and to within 2 mm, preferably to within 1.5 mm. But it is difficult to produce a cast power end frame, as described above, that exhibits such accuracy and that can be cast in a manner that minimises the risk of weak zones within the power end frame as a result of uneven thermal gradients, for example.

Furthermore, the power end frame 100 also requires an interior framework that comprises various elements, such as ribs, and struts, curved portions, and angular portions. Using a typical casting process, the various external and internal angles and the differences in draft angles of the power end frame would typically create inaccurate angles and dimensions in the frame 100 that are beyond the acceptable tolerances for a power end frame. In effect, the detailed nature of the interior of the power end frame 100 and the need for accuracy in the positions of the crosshead tubes 130 relative to each other means that it is difficult to form a cast power end frame 100 of sufficient quality using existing casting processes with a single part core.

Therefore, as shown in FIGS. 22 to 29, the invention comprises a modular core 300 comprising a plurality of core segments 200 that are configured to stack horizontally with each other. Each core segment comprises at least one engagement feature, on each side of the core segment, to engage with an adjacent core segment in the horizontal stack and to ensure that the adjacent core segments are correctly aligned with each other. By correctly aligning the core segments, it is possible to produce a cast power end frame comprising crosshead tubes 130 that are aligned in parallel to within 2 mm and preferably within 1.5 mm.

Each core segment 200 is configured to engage with another of the core segments to create a series of aligned core segments that together form a modular core 300 that is insertable within a mold for a power end frame 100 of the invention. Preferably, each core segment 200 is nestable with an adjacent one of the other core segments of the modular core 300.

Figure 22:
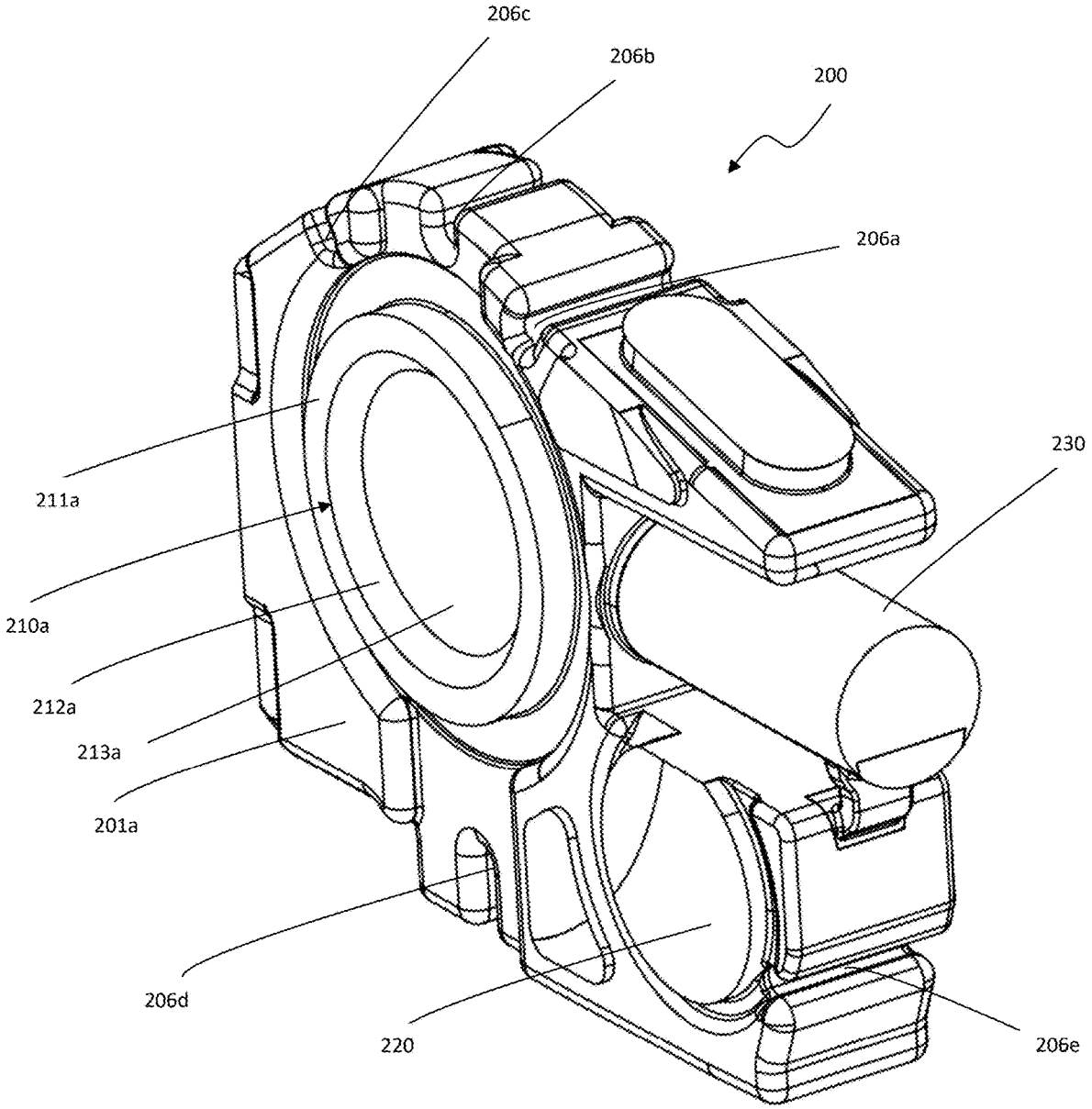
FIG. 22 is a left side isometric view of one form of core segment of the invention.
Figure 23:
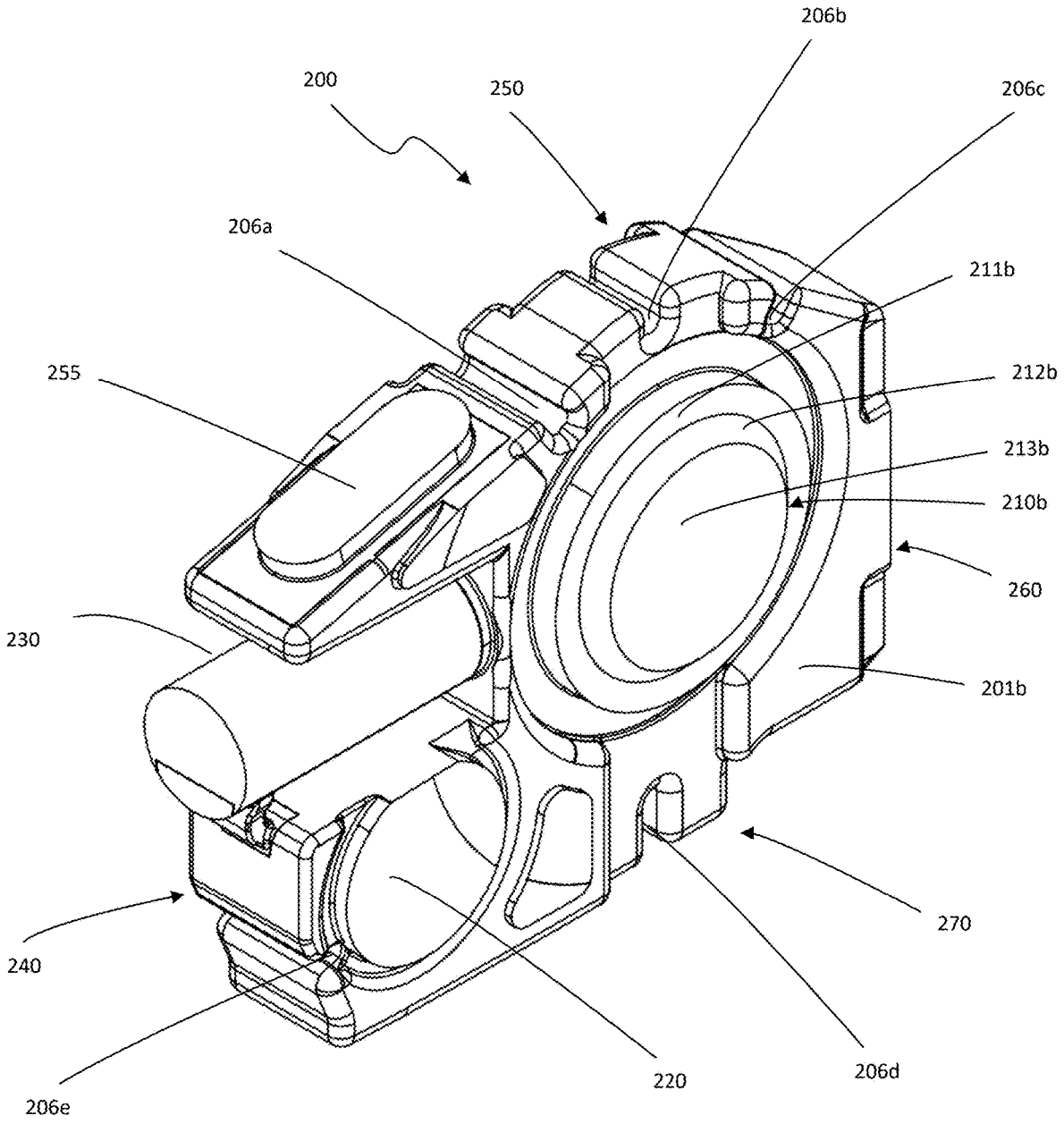
FIG. 23 is a right side isometric view of the core segment of FIG. 22.
Figure 24:
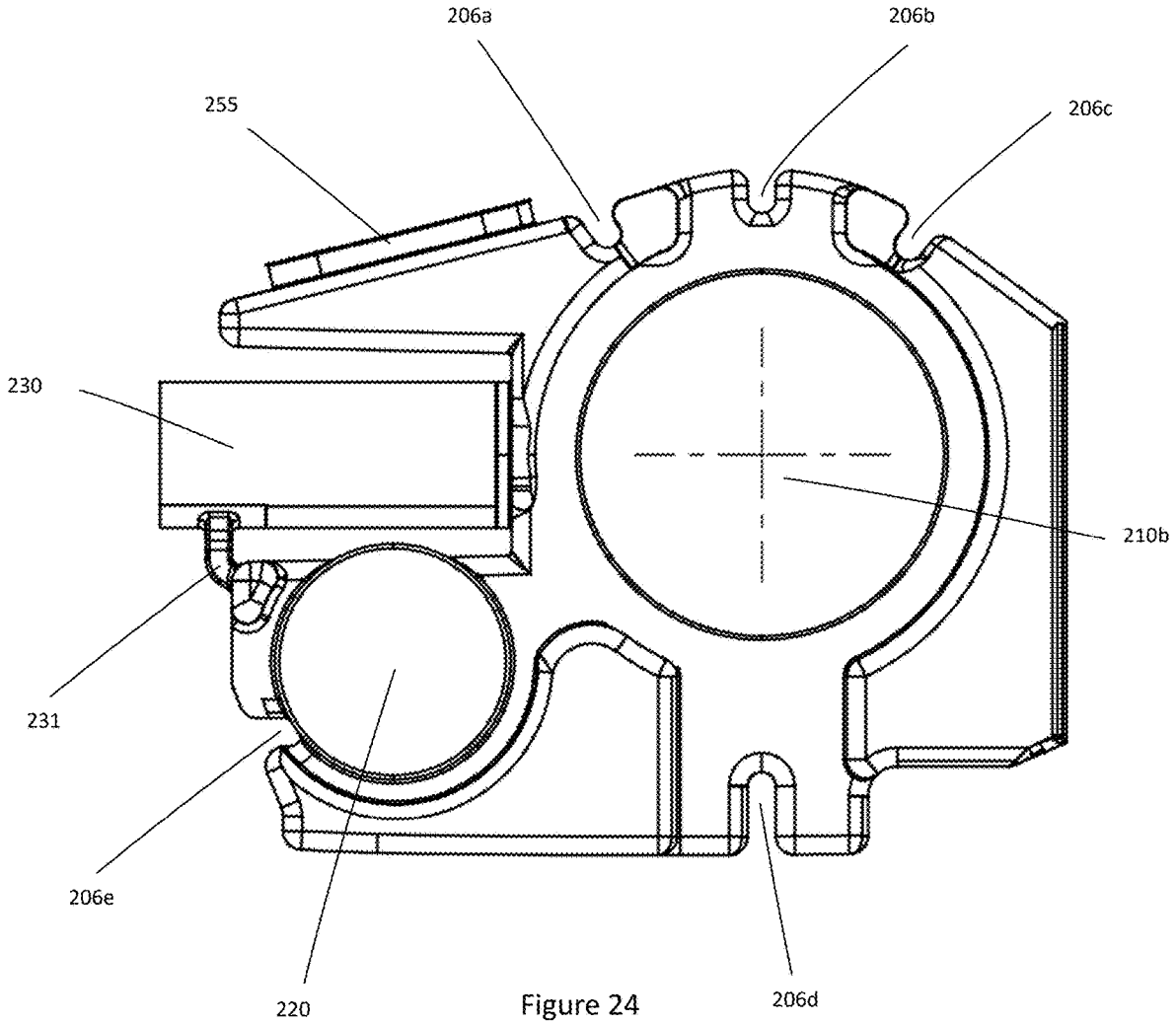
FIG. 24 is a right side view of the core segment of FIG. 22.

For example, as shown in FIG. 22 to 24, each core segment 200 comprises a pair of opposing first and second sides 201*a*, 201*b*; a front portion 240; an upper portion 250; a rear portion 260; and a lower portion 270. When stacked horizontally together, the front, upper, rear, and lower portions of each core segment together form a front portion 340, upper portion 350, rear portion 360, and lower portion 370 of the modular core 300. When located within the mold, the front, upper, rear and lower portions of the core are located adjacent to, but (in some cases) distanced from, front, upper, rear and lower portions of the mold pattern to allow molten metal to flow between the pattern and core segment and to then solidify to form the power end frame having front, upper, rear, and lower portions that are respectively formed within the adjacent front, upper, rear, and lower portions of the core 300 and the pattern. In the embodiment shown in FIG. 15, the core rests on an interior wall of the mold such that molten metal is prevented from flowing between the contacting surfaces of the core 300 and the mold 410. Thus, the shape of the external surfaces of the core segments 200, and the resulting core 300, together with the shape of the internal wall surfaces of the pattern, define a shaped space between the core 300 and the mold 410, that (when filled with molten metal) defines the cast shape of the power end frame 100.

The modular core 300 may be used to mold a power end frame of steel grade material, or other suitable material such as ductile iron.

As shown in FIG. 22 to 24, the front portion 240 of each core segment comprises a crosshead plug 230 for forming the hollow interior of a crosshead tube 130 within the cast power end frame 100.

The first side 201*a* of each core segment 200 comprises a first engagement feature and the second side 201*b* comprises a second engagement feature. The first engagement feature of the core segment is configured to engage with (such as be nestable with) the second engagement feature of an adjacent core segment to locate the two core segments relative to each other to ensure that the core segments are substantially in parallel with each other in order to accurately control the position of the crosshead tubes in the cast power end frame 100. In effect, a plurality of the core segments 200 are stackable horizontally, such that adjacent ones of the core segments engage with each other to form a modular core comprising parallel crosshead plugs 230 for use when casting the power end frame.

In preferred forms, the first and second engagement features are nesting features that allow the first side of a core segment to nest with the second side of an adjacent core segment as the first engagement feature nests with the second engagement feature. The nesting engagement features may take any suitable form, provided that the engagement feature of the first side is nestable with the engagement feature of the second side.

For example, in one form, not shown, the first engagement feature may comprise a concave region and the second engagement feature may comprise a convex region configured to receive at least a portion of the concave region of an adjacent core segment therein in a nested arrangement. Alternatively, the first engagement feature may comprise the convex region, and the second engagement feature may comprise the concave region.

In another example, one of the first and second engagement features may comprise a plug that projects from the respective side of the core segment, perpendicular to a central longitudinal axis of the core segment. The other of the first and second engagement features may comprise a socket, extending inwardly toward the central longitudinal axis and also perpendicular to that axis, for receiving the plug therein.

In yet another example, as shown in FIG. 22, the first side 201*a* of each core segment comprises a first engagement feature 210*a* comprising a first locating element 211*a*, an optional first guiding feature 212*a*, and a first abutment surface 213*a*. As shown in FIG. 23, the second side of each core segment comprises a second engagement feature 210*b* comprising a second locating element 211*b*, an optional second guiding feature 212*a*, and a second abutment surface 213*a*.

In the embodiments shown, the first locating element 211*a* comprises an annular collar and the second locating element 211*b* comprises an annular channel configured to receive the annular collar 211*a* therein.

The first and second guiding features 212*a*, 212*b* each comprise a sloping surface that slopes inwardly toward the first and second abutment surfaces 213*a*, 213*b* respectively. The sloping surfaces of the guiding features 212*a*, 212*b* help guide the core segments into an engagement position in which the first engagement feature of one core segment aligns with and nests with the second engagement feature of another core segment. The sloping surfaces also allow for easy release of the core segments during disassembly of the modular core. An alternative option is to employ a perpendicular surface between each locating element and respective abutment surface, but the tightly radiused corner of such an arrangement can make it more difficult to correctly engage multiple core segments together, and to disengage the core segments from each other.

The first abutment surface 213*a* is located closer to a central longitudinal axis of the core segment 200 than is the second abutment surface 213*a*, such that the first guiding feature 212*a* and first abutment surface 213*a* form a recessed region within the first locating element 211*a*, and the second guiding feature 212*b* and second abutment surface form a projecting region within the second locating element 211*b*. Preferably, each of the first and second abutment surfaces are flat, but it is also envisaged that one of the first and second abutment surfaces may be concave and the other of the first and second abutments surfaces may be convex, or the abutment surfaces may be of other complementary, nestable shapes.

In the embodiment shown in FIGS. 22 to 24, the first guiding surface slopes inwardly from the first locating element 211*a* to the first abutment surface 213*a* to form a recessed region within the first locating element, and the second guiding surface slopes outwardly from the second locating element 211*b* to a second abutment surface 213*b* to form a projecting region within the second locating element.

Figure 28:
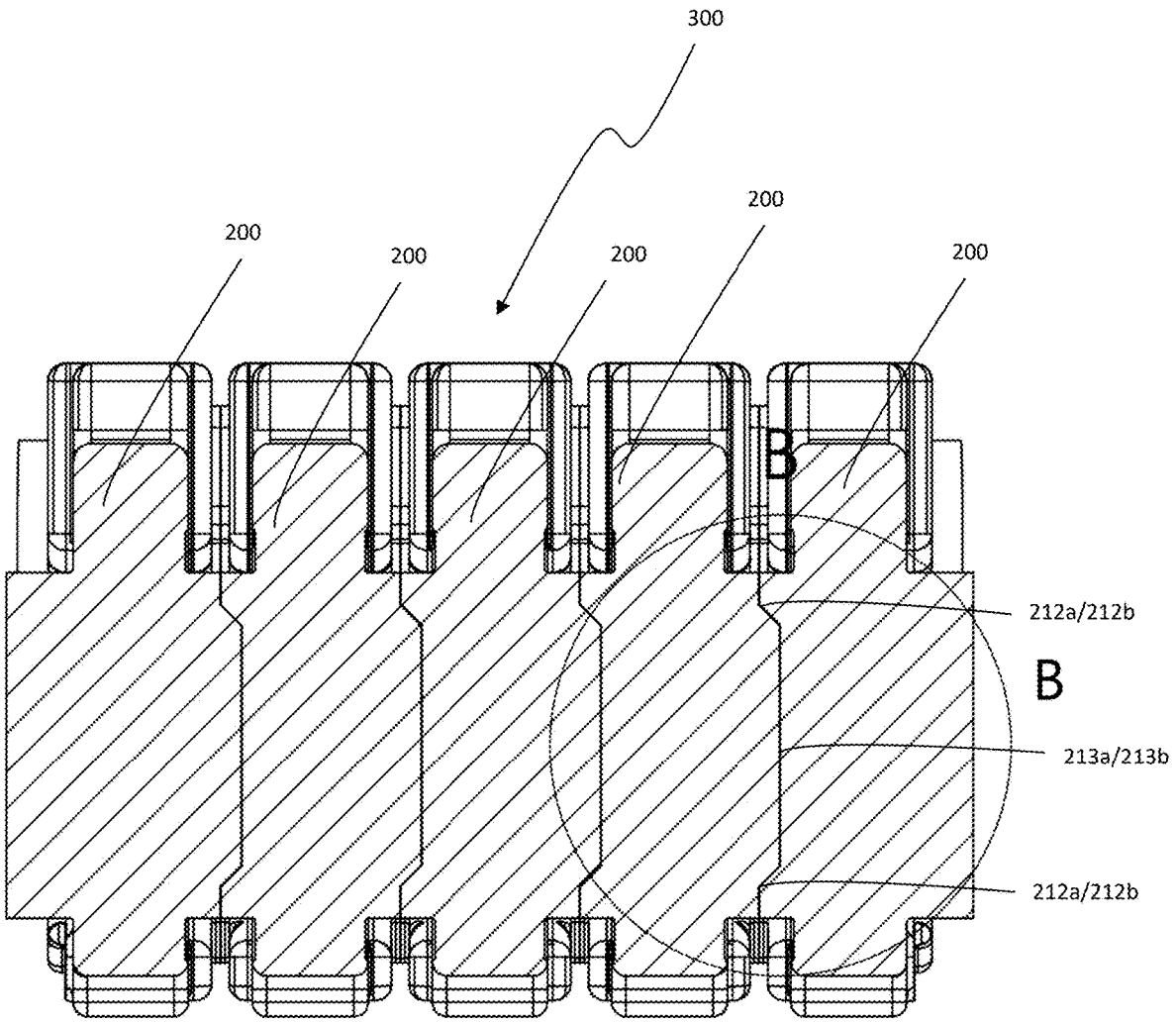
FIG. 28 is a cross-sectional view taken along the line C-C of FIG. 25.
Figure 29:
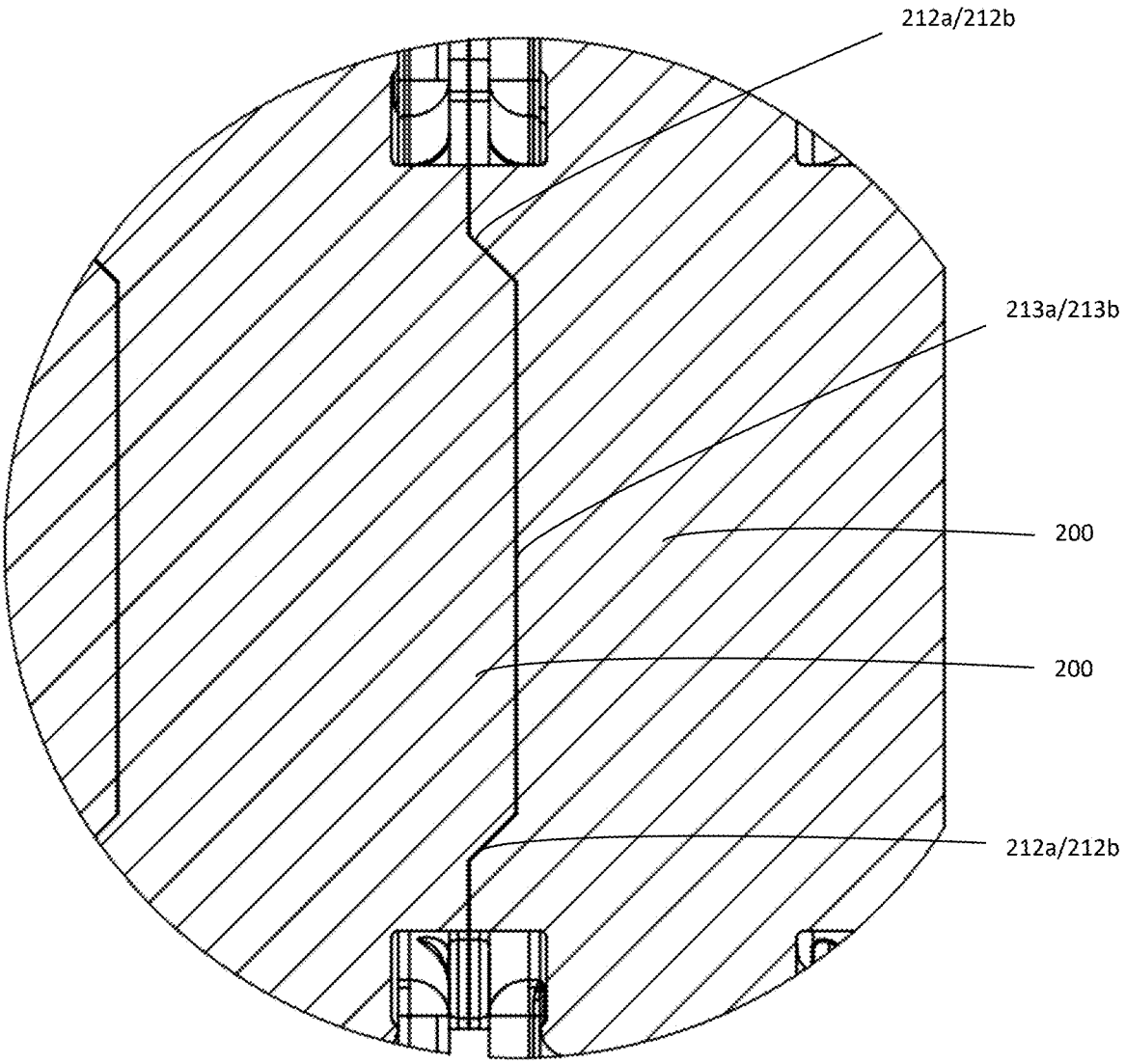
FIG. 29 is an enlarged view of area B of FIG. 28 showing adjacent core segments nested together.

The engagement features 110*a*, 110*b* of the core segment shown in FIGS. 22 to 24 allow the annular collar of the first locating element 211*a* of a first core segment 200 to be slidably received within the annular channel of the second locating element 211*b* of a second, adjacent core segment 200. As the collar is pushed into the receiving annular channel, the optional guiding features 212*a*, 212*b* help guide the two core segments toward each other, each of the sloping guiding surfaces sliding over the other until the first abutment surface 213*a* of the first core segment abuts firmly against the second abutment surface 213*b* of the second core segment. At this stage, the first and second core segments are nested together, as shown in FIGS. 28 and 29.

Typically, the first and second engagement features 210*a*, 210*b* are located on the core segment 200 in an area that corresponds with the crank shaft housing 110 of the power end frame 100, when cast using the modular core 300.

As can be seen from FIGS. 22 to 24, the upper portion 250 of each core segment comprises an inspection port plug 255, and may also comprise one or more channels 206 that receive molten metal therein to form ribs 106 of the power end frame. In the embodiment shown in FIG. 22, three channels 206, 206*b*, 206*c* are provided in the upper portion 250 to produce three longitudinal ribs in the upper portion 150 of the cast power end frame 100.

The lower portion 270 optionally comprises at least one inwardly projecting channel 206*e* to form a transmission support rib 106*e* to support a transmission shaft housing 120 of the power end frame 100.

Additionally, or alternatively, the lower portion 270 may comprise at least one inwardly projecting channel 206*d* that projects toward a central point of the equivalent crank shaft housing location on the core segment 200 to form a lower rib 106*d* in the power end frame 100 that projects towards the central longitudinal axis of the crank shaft housing 110 of the frame 100. In the embodiments shown in FIGS. 22 to 24, the first and second engagement features 210*a*, 210*b* of the core segment 200 define the equivalent crank shaft housing location and the channel 206*d* projects toward a centre of the locating element 211*a*, 211*b* on each side of the core segment 200.

The channels 206*a*-206*e* each extend across the width of the core segment 200.

The lower portion of each core segment may comprise a supporting surface on which the core segment can stably rest on the ground. In preferred forms, the lower portion of each core segment is a flat surface that is located on a bottom wall of the mold that forms the rear surface of the power end frame (in effect, the core is placed in the mold on its back).

Figure 25:
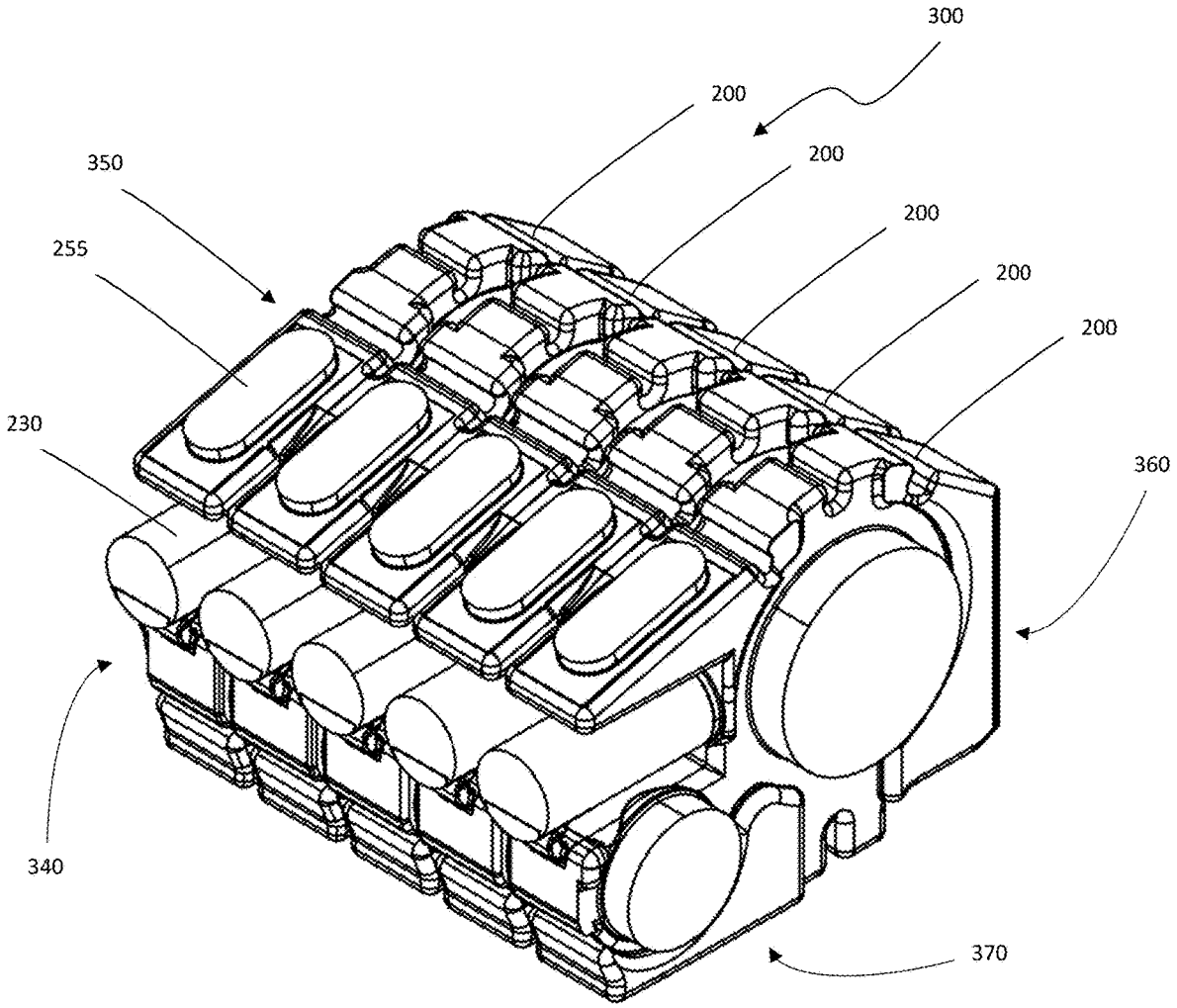
FIG. 25 is an isometric view of a modular core comprising a plurality of core segments, as shown in FIGS. 22 to 24, nesting together.
Figure 26:
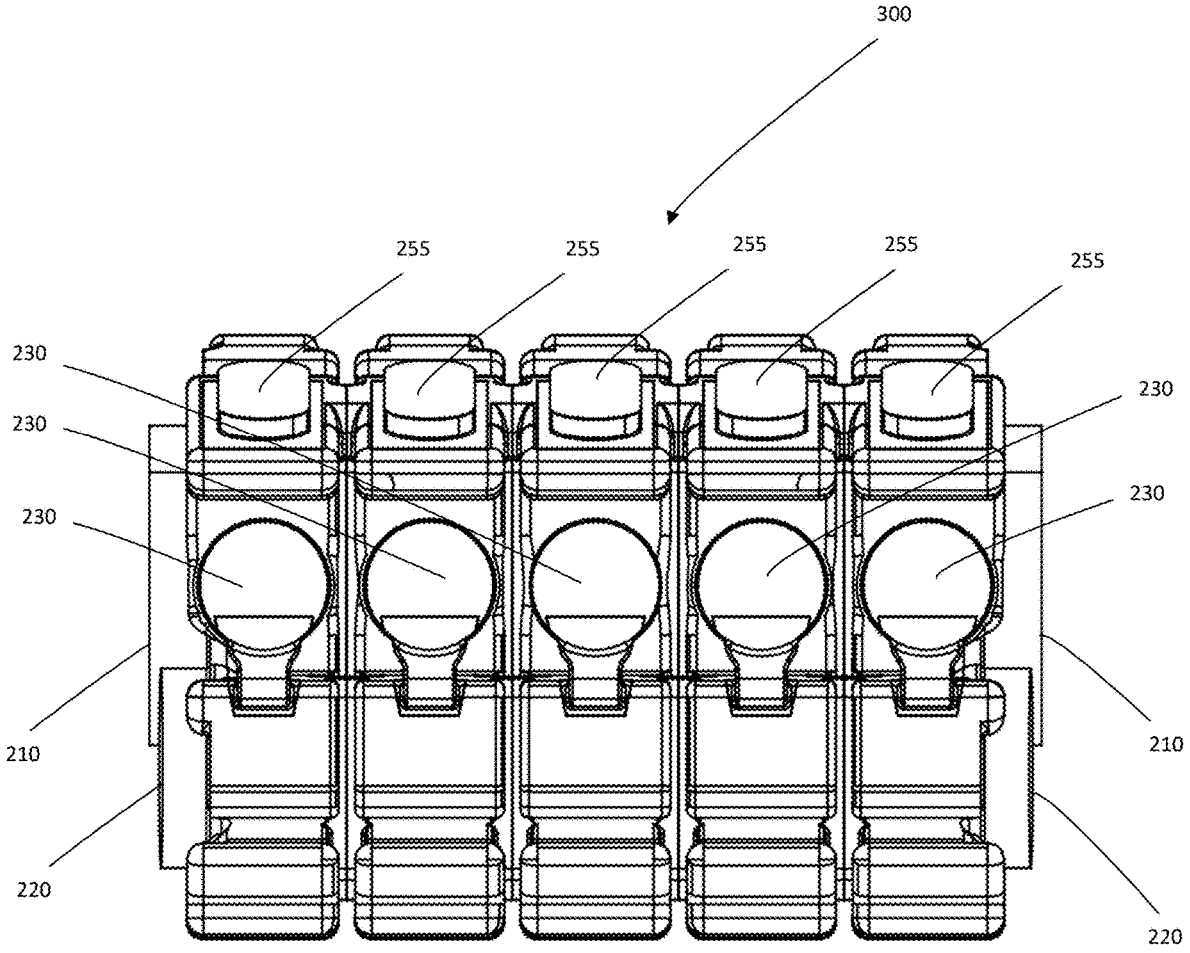
FIG. 26 is a front view of the modular core of FIG. 25.
Figure 27:
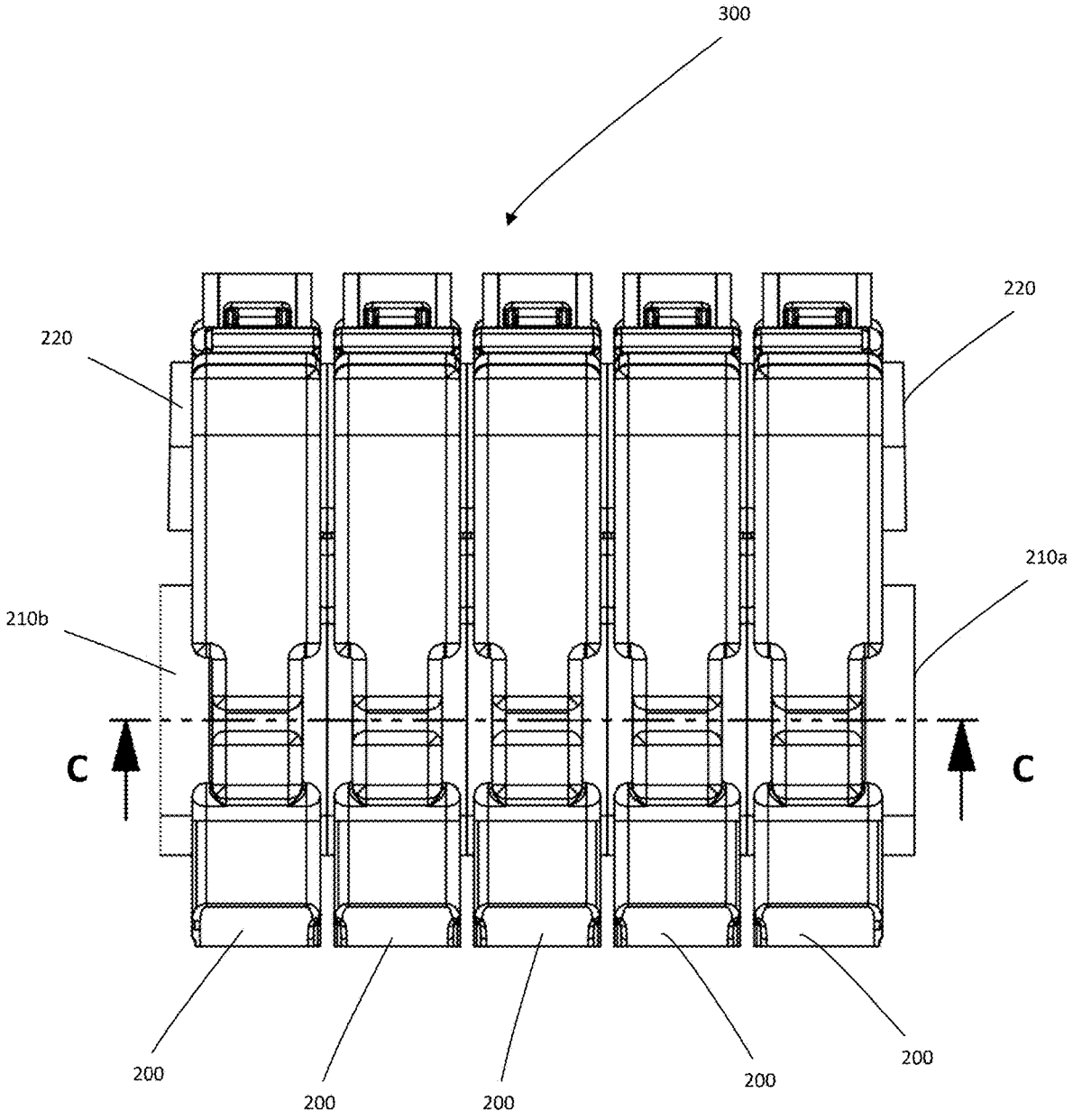
FIG. 27 is a bottom view of the modular core of FIG. 25.

To assemble the modular core 300, multiple core segments are located proximate to each other in a side-by-side arrangement with the first side 201*a* of each core segment facing toward the second side 201*b* of an adjacent core segment, except for the core segments at each end, which will have only one side that is adjacent another core segment. Adjacent core segments are pushed together so that the first and second engagement features of the adjacent core segments engage with each other to form a modular core 300 comprising a plurality of horizontally stacked core segments 200, as shown in FIGS. 25 to 27. In other words, the core segments 200 are pushed together such that at least one of the first and second engagement features of each core segment engages with at least one of the other of the first and second engagement features of an adjacent core segment to form a modular core 300.

By supporting the core segments 200 on a flat surface as adjacent segments are pushed together to engage with each other, the core segments 200 are aligned so that the crosshead plugs 230 are substantially parallel with each other in order to produce accurate casting of the crosshead tubes 130 to within 1.5 mm to 2 mm.

At least one space 500 is formed between the core 300 and the interior surfaces of the mold 410 to allow molten metal to flow over and around the core 300 and into the space(s) 500, thereby creating the exterior and interior surfaces of the power end frame 100 once the molten metal has solidified to form a cast product/power end frame.

Figure 13:
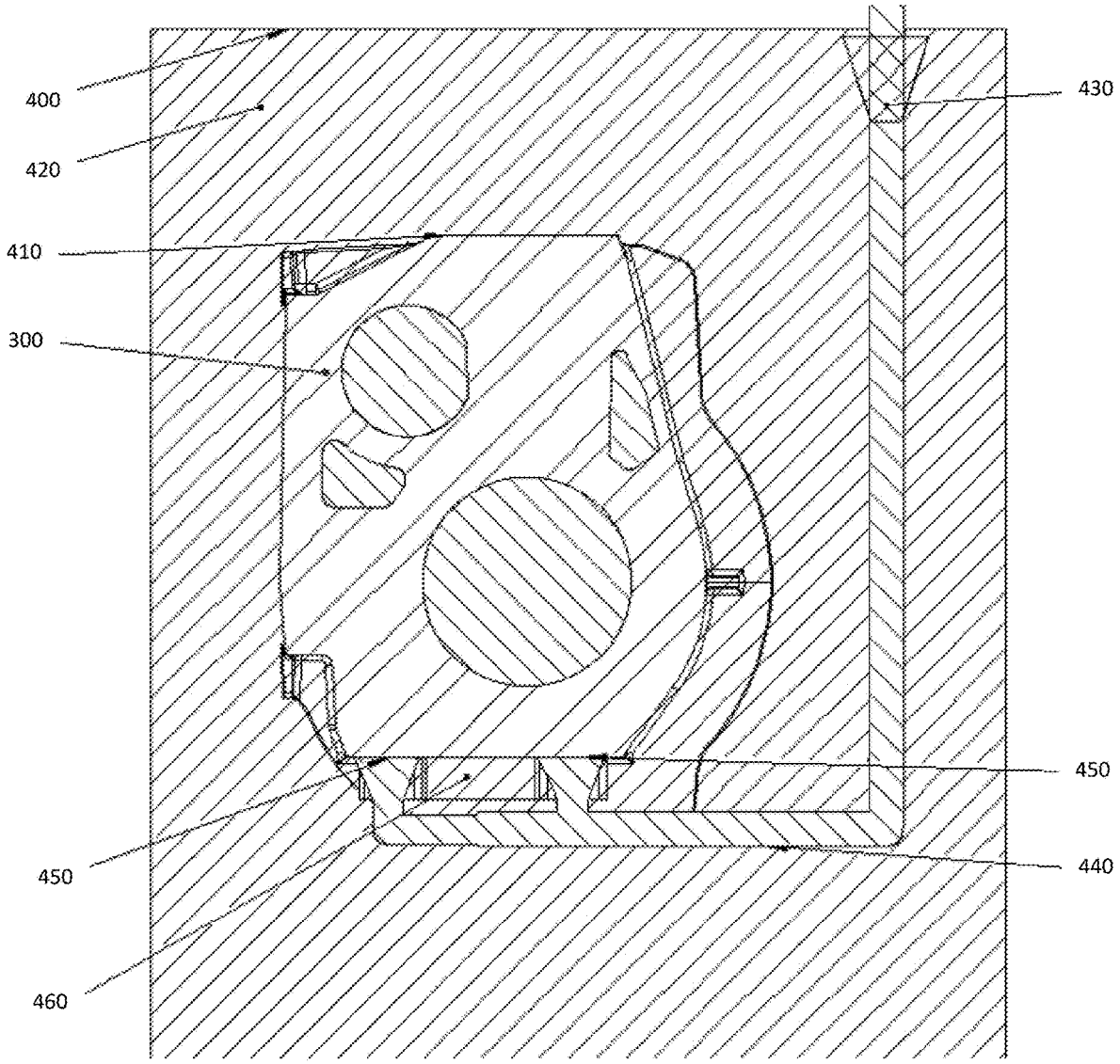
FIG. 13 is a cross-sectional schematic side view of one half of one form of mold for a power end frame, showing a core located within a half of a molding box.
Figure 14:
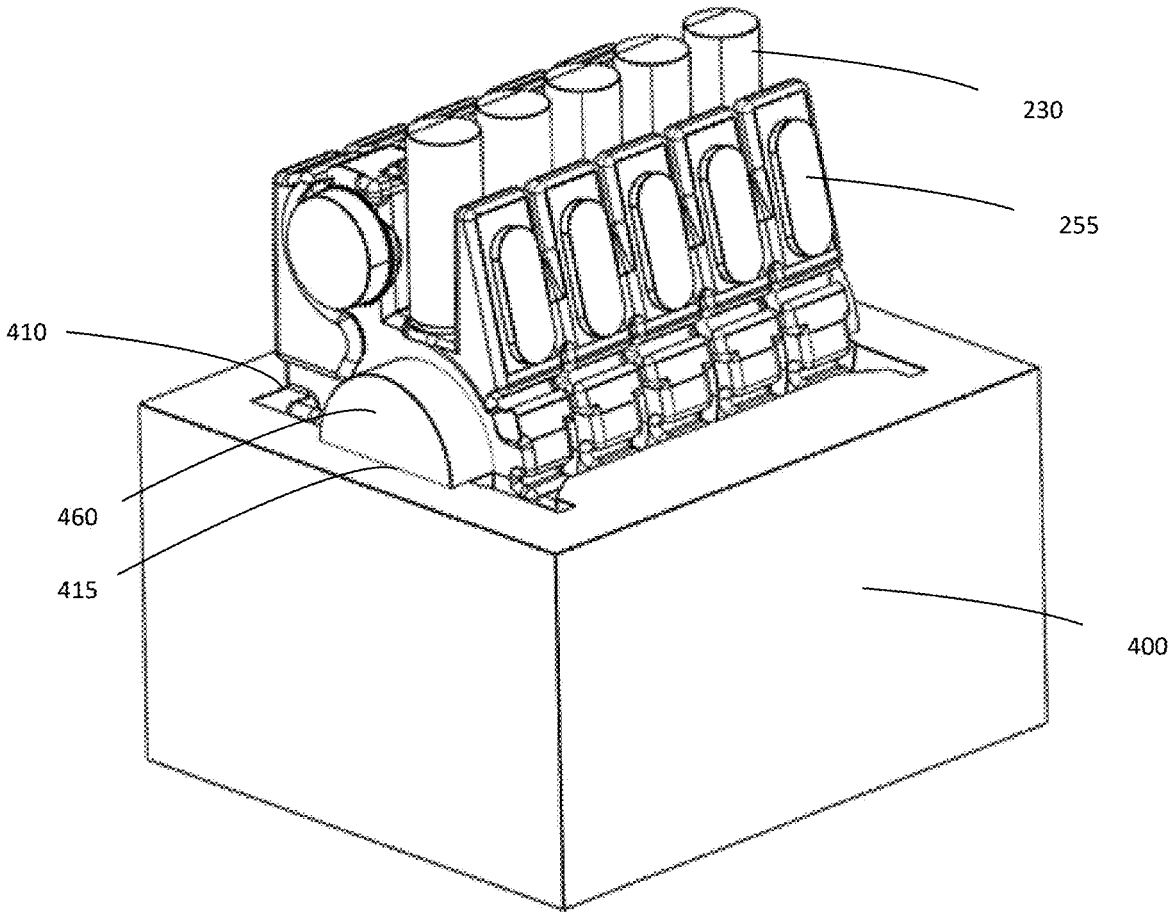
FIG. 14 is an isometric view of one form of modular core located within one form of molding box for casting a power end frame.

In some forms, as shown in FIG. 13, the core 300 is located in the desired position within the mold (so as to be spaced from the mold in at least some regions), by a print 460 that holds the core 300 at each side. Each print 460 forms a shoulder that supports the core 300 on or within a print retaining element 415 of the molding box 400 during casting, as shown in FIG. 13. In some forms, the outer core segments that form each end of the core 300 may comprise a print 460 to locate the modular core 300 within the mold 410. The print 460 may be integrally formed with the outer core segments 200, such that each outer core segment and respective print is formed as a single part. Alternatively, each print may be secured to a respective core segment by any suitable arrangement, such as by fasteners or welds, for example. In the embodiment shown in FIG. 14, each print has a cylindrical shape.

In other forms, the core segments 200 may be secured together, such as by clamping the core 300 at each end to press the core segments 200 securely to each other, or by forming a threaded aperture through the core (such as through the aligned core segments) so that the aperture extends the length of the core and then inserting a threaded a metal rod through the threaded aperture to secure the core segments together.

FIGS. 13 to 16 illustrate one method of locating a core within a mold for a power end frame, ready to cast the power end frame.

Figure 15:
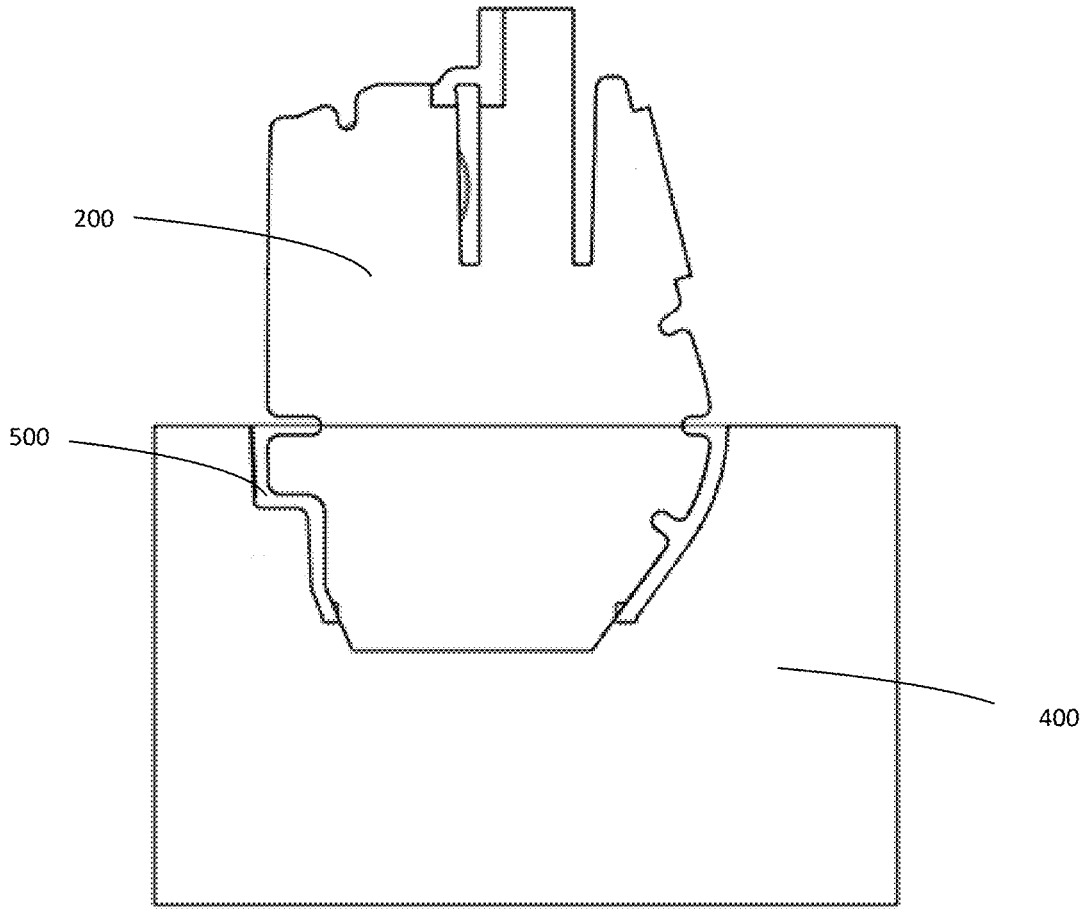
FIG. 15 is a schematic cross-sectional side view of the modular core within one half of the molding box, as indicated in FIG. 14.

As shown in FIGS. 13 to 16, the core 300 is located within the mold 410, ready for casting the power end frame 100 by locating each print within the molding box 400 (such as by locating each print 460 on or within a print retaining element 415 that supports each print 460 from below, or otherwise fastening each print to the molding box). In the embodiment shown in FIG. 14, each print comprises a cylindrical boss and each print retaining element 415 comprises a cylindrical recess located in opposing side walls of the mold 410. In some forms, as shown in FIG. 15, the core 300 may rest on a bottom wall of the mold 410. In other forms, the core 300 may be suspended within the mold 410.

One or more risers 430 are provided in fluid communication with the interior of the mold, as shown in FIG. 13. Each riser (which may also be considered to be a tube or in-gate) connects with one or more runner(s) 440 and gate(s) 450 to form a fluid flow path to the interior of the mold. Each riser 430 is placed within the hardened particulate infill 420. Each riser 430 receives molten metal during the pouring step of the casting process and feeds the liquid metal into the mold via the one or more runners 440 and gates 450. Each runner 440 is used to direct molten metal to a particular area of the pattern and each gate 450 is configured to control the flow of metal into the mold.

In preferred forms, each riser 430 comprises a ceramic tube fitted within the particulate infill 420 of the molding box 400 and held in position once the particular hardens. The ceramic wall lining of each riser 430 prevents particulates from the molding box infill 420 entering the flow of molten metal through the riser. Each ceramic lined riser 430 is also heat resistant and has insulating properties to minimise heat loss as molten metal is fed into each riser.

Each riser 430 is in fluid communication with a series of interconnected runners 440 and gates 450 configured to fill the interior of the mold 410 from below.

To cast the power end frame 100 of the invention, molten metal, such as alloy steel, is melted in a furnace, such as an electric induction furnace or a basic oxygen furnace, and is heated to a temperature above its melting point, such as a temperature between about 1600-1700° C.

The molten metal is refined to achieve the desired chemical composition and properties. This may involve degassing, alloying, and deslagging.

The molten metal is then carefully poured into one or more vertical risers 430 of the molding box 400. The risers 430 provide a reservoir of molten metal that is the fed to the mold in a controlled manner through a system of runners 440 and gates 450. The runners 440 provide fluid flow paths from the riser(s) 430 to the mold 410, and the gates 450 are sections where a runner 440 meets the mold 410. The runners 440 are connected to the interior of the mold 410 from below. Typically, the gates 450 are designed to have a tapered portion to control the velocity at which molten steel from the riser(s) 430 enters the mold 410, and to enable easier removal of the runners 440 after the cast product has solidified.

Gravity causes the metal to flow down each riser 430 and through the interconnected runners 440 and gates 450 to rapidly fill the interior of the mold 410 from below. As molten metal is fed into the interior of the mold 410, the metal flows around the core 300 and fills the space 500 between the exterior surfaces of the core 300 and the interior surfaces of the mold 410. As the metal cools and solidifies, its outer surfaces substantially adopt the shape of the interior surfaces of the mold 410 and the exterior surfaces of the core 300 to form the skeletal structure of the power end frame 100 of the invention.

The molten metal rises and flows through the mold 410 as more molten metal is fed into the runners 440 from each riser 430. Thus, during filling, the metal at the bottom of the mold (where the molten metal is fed into the interior of the mold) consistently remains hot to avoid an uneven thermal gradient with the incoming molten metal. Preferably, the mold is filled within about 30 seconds to about 60 seconds. Rapid filling of the mold also ensures that the thinner sections of the cast product do not cool prematurely and inconsistently with the thicker sections.

The speed at which the mold is filled with molten material is important. If the mold is filled too rapidly, turbulence is created in the molten metal, which can result in air pockets that create weaknesses in the resulting casting. If the mold is filled too slowly, the risk of significantly uneven temperature gradients increases, which can also create weaknesses in the resulting casting. Thus, the casting process of the invention fills the entire mold for the power end frame within about 30 to about 60 seconds.

As the molten metal fills the enclosed mold 410, air within the mold is compressed, pressurising the atmosphere within the mold and further slowing the cooling process of the metal. Pressure relief risers (not shown) are provided in the mold 410 to allow overfill from the mold during the casting process to flow into the relief risers, together with compressed gas.

In summary, a method of casting a power end frame of the invention comprises the steps of connecting at least one ceramic riser 430 to a plurality of runners 440 that are in fluid communication with an interior of a mold 410 and that connect to the mold from beneath the mold, filling the mold interior with molten metal comprising steel comprising a carbon constituent of 0.06%-1.99% carbon within about 30 to about 60 seconds, and allowing the molten metal to solidify.

By filling the mold from below to create positive pressure within the mold, it is also possible to increase the density of the casting/cast product as the weight of the metal above presses down on the warmer metal below. The denser material of the cast power end frame of the invention has been found to provide the power end frame with additional durability and robustness.

The metal is allowed to cool and solidify within the mold. The mold is kept in a controlled environment to ensure uniform cooling of the casting in order to minimise thermal stresses on the casting until the casting solidifies. The cooling and solidification process is closely monitored to detect defects in the cast product, such as shrinkage, porosity, and cracks.

The solid casting/cast product is then released from the mold, cleaned and heat treated to provide the casting with desired mechanical properties. Heat treatment includes annealing in which the casting is first heated to a specific temperature (such as about 980° C. and then slowly cooled to relieve internal stresses and improve ductility. The casting is then heated to a high temperature (such as within the range of about 980° to about 1050°, and preferably about 1020°) and rapidly cooled in a quenching process to increase the mechanical properties of the casting. The casting is subsequently reheated in a tempering process (typically to temperatures of between about 450° C. and 550° C.) to achieve the desired balance of hardness and toughness.

Figure 17:
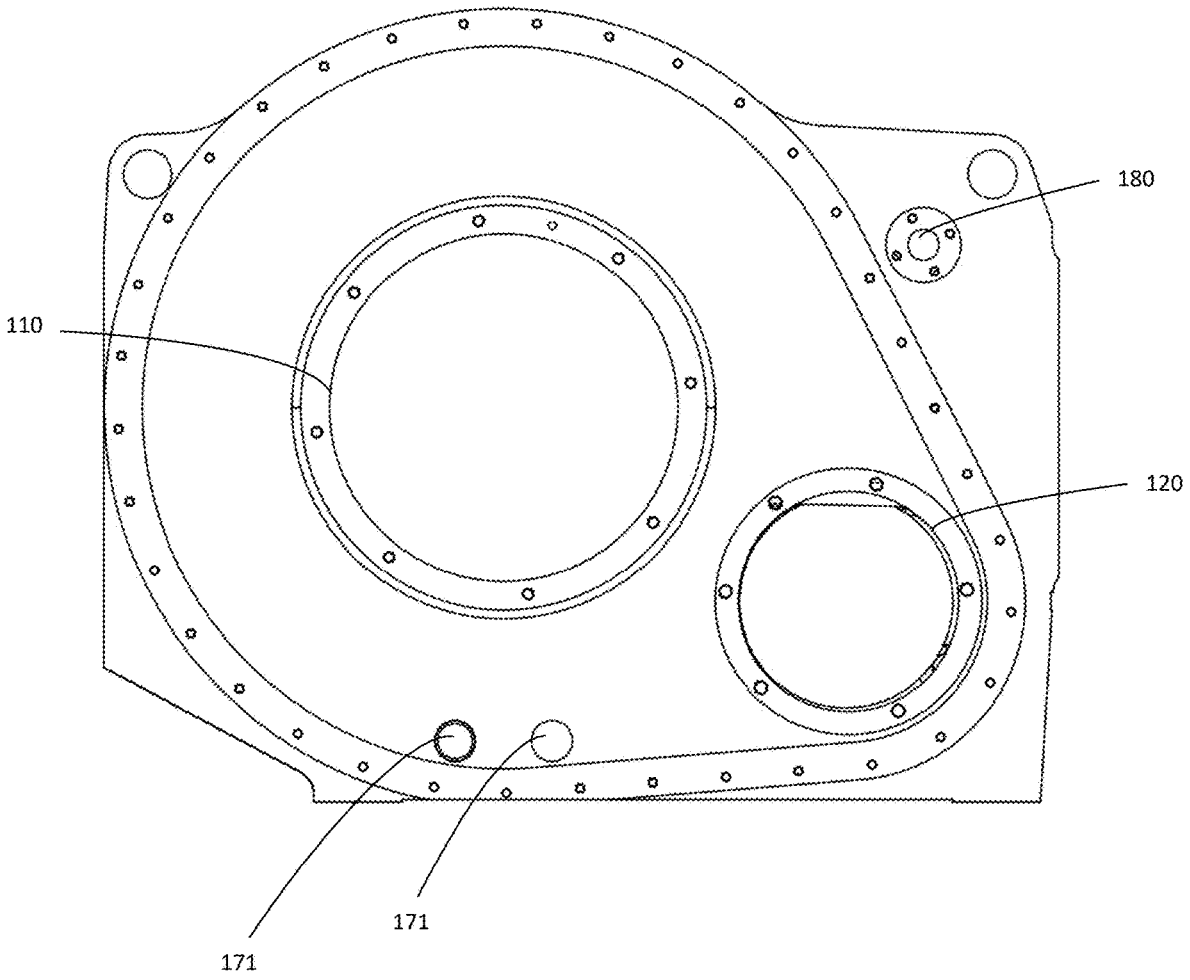
FIG. 17 is a side view of the power end frame of FIG. 8 after additional features have been machined into the frame, and comprising drainage holes in the lower portion of the frame.
Figure 18:
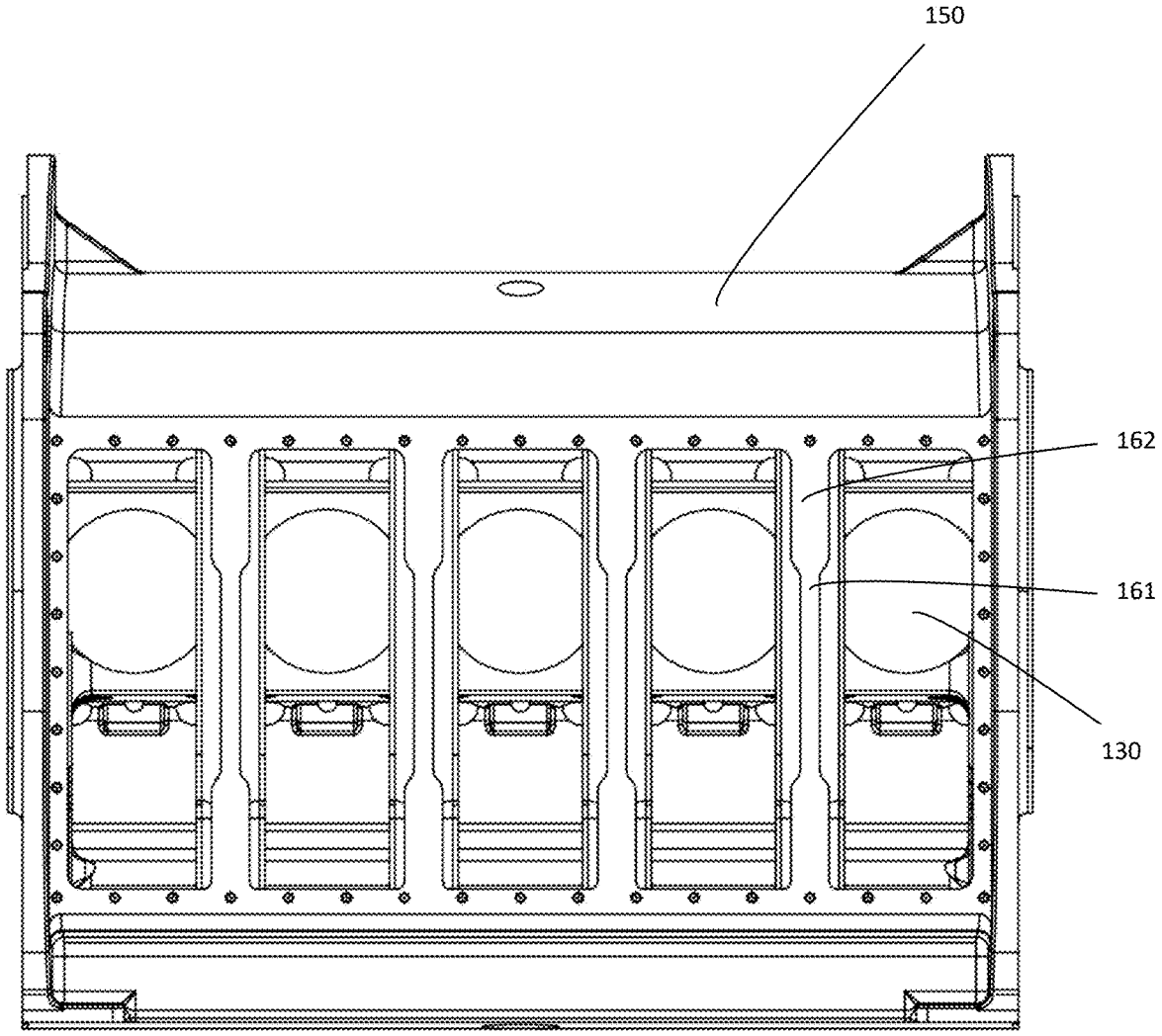
FIG. 18 is a rear view of the power end frame of FIG. 17 and showing thickened regions of the rear upright members.
Figure 19:
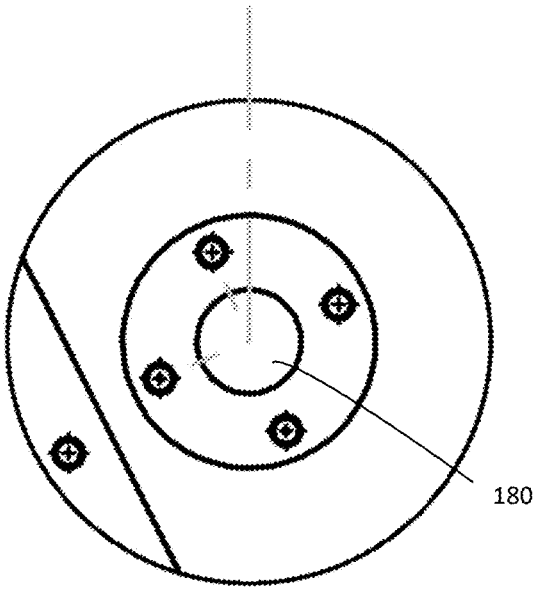
FIG. 19 is an enlarged view of a lubricating port that is machined into the power end frame, as indicated also in FIG. 17.
Figure 20:
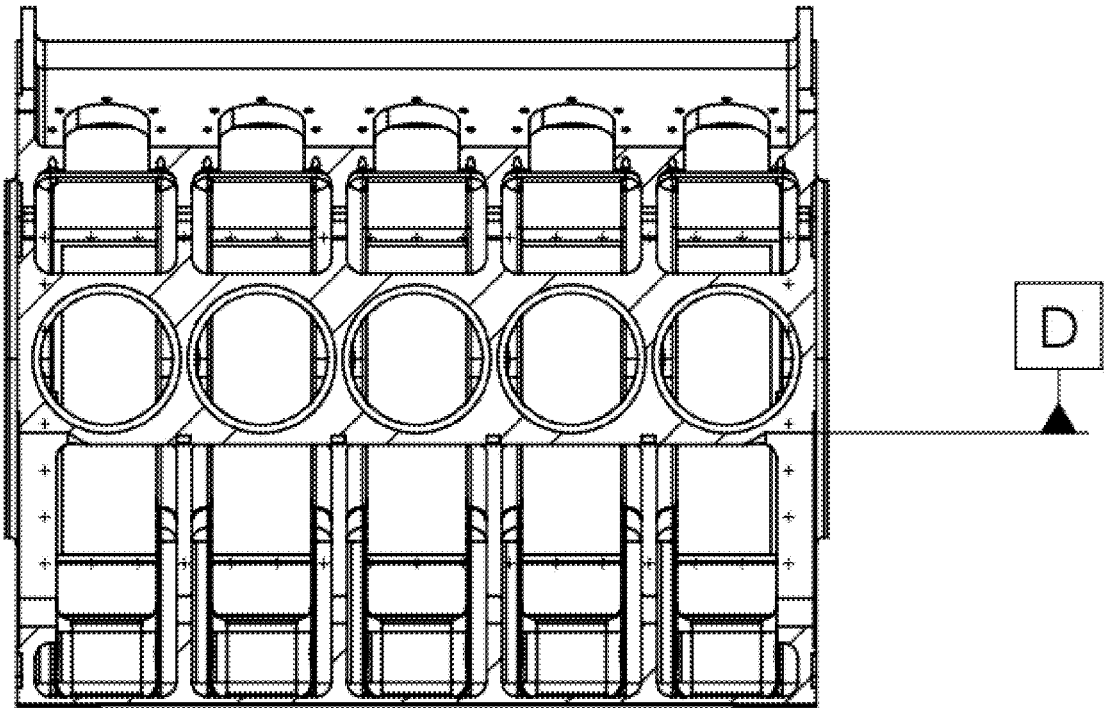
FIG. 20 is a partial cut-away front view of the machined power end frame of FIG. 17, showing the crosshead tubes located beneath the inspection ports.

The skeletal power end frame casting is then machined to remove excess material and to shape the casting to its final dimensions. During the machining process, specific features may be added to the casting, such as drainage holes in the lower portion of the outer casing 105, and surfaces may be smoothed. In some forms, lubricating oil access ports may be machined into the casting, as shown in FIGS. 17 and 19. The final power end frame 100 is then ready for inspection and testing before use.

However, the power end frame 100 includes areas in which the metal is thick and areas in which the metal is thin. During casting, areas of thinner metal cool faster than areas of thicker metal, such that different regions of the casting are subject to different cooling rates. As a metal cools, it contracts, so those regions that are cooling quickly tend to contract at a different rate to those regions that are cooling more slowly, i.e. the thermal gradient between the two regions is significantly unequal. The region where a faster cooling metal meets a slower cooling metal therefore tends to form inconsistencies in the structure of the cast metal as the contracting metal pulls against the hotter metal, leading to weaknesses in the cast power end frame.

Furthermore, the high temperatures required to cast a power end frame of the size required for the oil industry tend to cause particulates, such as sand, from the particulate infill in the molding box to be melted or scoured away and for small particulates to be collected by the molten metal passing through the riser(s). As the metal solidifies into the desired shape within the mold, the particulates form inclusions within the metal. These inclusions are undesirable as they create weak spots within the power end frame.

Therefore, to take advantage of the properties of steel grade material, such as alloy steel, it is necessary to minimise the differences in thermal gradient between thicker regions and thinner regions of the power end frame, and to reduce the instances of inclusions in the metal, in order to produce a power end frame of sufficient quality for its intended purpose. Existing molds and casting processes have been found to be unsuitable to cast a power end frame from steel grade material and so the applicant has developed a new mold and casting process.

Because it is not possible for an operator to visually inspect the interior of the mold during the casting process, software may be employed to animate the casting process on a display screen in real-time. The software may be configured to display an image of the casting as it is being formed, such as the filling of the mold and to provide an indication of comparative temperatures of the metal within the mold to assist an operator to detect weaknesses within the casting. For example, the temperature of various regions of the casting may be indicated by colour, such as red for hot areas and blue for cool or cooling areas. Thus, the software may display hot spots and significantly uneven thermal gradients within the casting in real time as the casting is in process. In this way, an operator can identify whether sufficiently uneven thermal gradients have formed within the casting process such that the quality of the casting may be compromised.

The invention may also be said broadly to consist in the parts, elements and features referred to or indicated in the specification of the application, individually or collectively, in any or all combinations of two or more of said parts, elements or features.

Although the invention has been described by way of example, it should be appreciated that variations and modifications may be made without departing from the scope of the invention as defined in the claims. Furthermore, where known equivalents exist to specific features, such equivalents are incorporated as if specifically referred in this specification.

The invention claimed is:

1. A cast power end frame comprising a pair of end plates and an outer casing extending between the end plates and defining an interior therein; a crank shaft housing extending between the end plates and within the interior of the outer casing, and a plurality of crosshead tubes, each crosshead tube extending substantially perpendicular to the crank shaft housing, wherein the outer casing, crank shaft housing, and crosshead tubes are cast as a single part comprising steel comprising a carbon constituent of 0.06%-1.99% carbon, wherein a rear portion of the power end frame comprises a plurality of vertical struts, and each strut comprises at least one widened portion.

2. The power end frame of claim 1, cast from alloy steel.

3. The power end frame of claim 1, wherein each crosshead tube comprises a drainage hole provided in a lower surface of the crosshead tube.

4. The power end frame of claim 1, wherein at least one oil drainage outlet is provided in the outer casing at a lower portion of the power end frame.

5. The power end frame of claim 1, and comprising at least three inwardly projecting ribs within an upper portion of the frame, the ribs extending between the end plates.

6. A reciprocating pump comprising a power end frame according to claim 1, and also comprising a fluid end coupled to the power end frame by a plurality of stay rods.

7. A cast power end frame comprising a pair of end plates and an outer casing extending between the end plates and defining an interior therein; a crank shaft housing extending between the end plates and within the interior of the outer casing, and a plurality of crosshead tubes, each crosshead tube extending substantially perpendicular to the crank shaft housing, wherein the outer casing, crank shaft housing, and crosshead tubes are cast as a single part comprising steel comprising a carbon constituent of 0.06%-1.99% carbon, wherein the cast power end frame further comprises at least three inwardly projecting ribs within an upper portion of the frame, the ribs extending between the end plates.

8. The power end frame of claim 7, wherein the power end frame is cast from alloy steel.

9. The power end frame of claim 7, wherein each crosshead tube comprises a drainage hole provided in a lower surface of the crosshead tube.

10. The power end frame of claim 7, wherein at least one oil drainage outlet is provided in the outer casing at a lower portion of the power end frame.

11. The power end frame of claim 7, wherein a rear portion of the power end frame comprises a plurality of vertical struts, each strut having at least one widened portion.

12. A reciprocating pump comprising a power end frame according to claim 7, and also comprising a fluid end coupled to the power end frame by a plurality of stay rods.

* * * * *